US006076460A

United States Patent [19]

Kagawa

[11] Patent Number: 6,076,460

[45] Date of Patent: Jun. 20, 2000

[54] MASTER MAKING DEVICE AND STENCIL PRINTER INCLUDING THE SAME

[75] Inventor: Hideyuki Kagawa, Sendai, Japan

[73] Assignee: Tohoku Ricoh Co., Ltd., Shibata-gun, Japan

[21] Appl. No.: 09/014,269

[22] Filed: Jan. 27, 1998

[30] Foreign Application Priority Data

Jan. 27, 1997 [JP] Japan ..... 9-012982

[51] Int. Cl.[7] ..... B41C 1/14

[52] U.S. Cl. ..... 101/128.4; 101/116

[58] Field of Search ..... 101/116, 128.21, 101/128.4, 129

[56] References Cited

U.S. PATENT DOCUMENTS

| | | | |
|---|---|---|---|
| 5,140,898 | 8/1992 | Igarashi | 101/128.4 |
| 5,586,497 | 12/1996 | Shimada | 101/128.4 |
| 5,640,904 | 6/1997 | Sato et al. | 101/128.4 |
| 5,673,619 | 10/1997 | Ohinata et al. | 101/128.21 |
| 5,713,279 | 2/1998 | Iida et al. | 101/128.4 |
| 5,782,179 | 7/1998 | Kagawa et al. | 101/128.4 |
| 5,816,149 | 10/1998 | Kagawa et al. | 101/128.4 |

FOREIGN PATENT DOCUMENTS 9-11597 1/1997 Japan .

*Primary Examiner*—Stephen R. Funk
*Attorney, Agent, or Firm*—Olbon, Spivak, McClelland, Maier & Neustadt, P.C.

[57] ABSTRACT

A master making device of the present invention includes a support member supporting a stencil roll such that a stencil can be paid out from the roll. A thermal head perforates the stencil paid out from the roll while a platen roller rotates while pressing the stencil against the head. The support member, thermal head and platen are constructed into a master making unit. The master making unit is removably mounted to the body of a printer via rails. A broader space than is conventional is available for the stencil to be set or replaced or for a jam to be dealt with without a document reading section being displaced relative to the printer body.

43 Claims, 16 Drawing Sheets

19
20
22a
22b
23
21b
21
21a
22
27
27a
38
26
X
24
37
25
35
35a
39
36
4b
4
4a
2
2b
3
15
10a
10
9
X1
X2
40
47
S
41
42
43
43a
33
34
44
Z1
Z2

MASTER MAKING DEVICE AND STENCIL PRINTER INCLUDING THE SAME

BACKGROUND OF THE INVENTION

1. Field of the Invention

The present invention relates to a master making device for making a master and a stencil printer including the same.

2. Discussion of the Background

A digital stencil printer is simple in construction and easy to operate and uses a thermosensitive stencil having a laminate structure. The stencil is made up of a thermosensitive resin film usually 1 μm to 2 μm thick and a porous substrate adhered to the film. The porous substrate is implemented by Japanese paper fibers or synthetic fibers of a mixture thereof. While the film surface of the stencil is held in contact with heating elements arranged on a thermal head, the head is operated in the main scanning direction in order to selectively perforate the stencil with the heating elements in accordance with an image signal. A platen roller or similar conveying means conveys the stencil in the subscanning direction for thereby completing a master. The master is automatically wrapped around a rotatable drum made up of a porous hollow cylinder and a plurality of mesh screens covering the cylinder. The mesh screens are formed of resin or metal. Ink is fed from ink feeding means disposed in the drum. A sheet is fed by a press roller, a press drum having substantially the same diameter as the drum or similar pressing means. The sheet is continuously pressed against the drum via the master. As a result, the ink is transferred from the drum to the sheet via a porous portion included in the drum and the perforations of the master.

Usually, the stencil for the above application is paid out from a roll mounted on a tubular paper core. The roll is rotatably set on a holder member playing the role of master storing means included in a master making device. The operator of the printer pulls the leading edge of the stencil away from the roll and inserts it between the thermal head and the platen roller or between a pair of conveyor rollers. Thereafter, the stencil is conveyed to the downstream side in a direction of stencil transport. After the leading edge of the stencil has been cut off for a matching purpose, a sequence of steps for wrapping a master around the drum are executed.

The resin film included in the stencil is apt to be charged by static electricity. The stencil is therefore apt to adhere to the platen roller or the conveyor rollers when inserted between the thermal head and the platen roller or between the conveyor rollers, jamming a stencil transport path. Further, the ink is transferred from the drum to the sheet via the Japanese paper fibers, or porous substrate, and the perforations of the resin film. This brings about a problem that when the fibers of the substrate are entangled in masses or when thick fibers extend across the perforations of the resin film, a solid image is locally lost or fine lines or characters are disconnected or blurred due to so-called fiber marks.

In light of the above, there has been proposed to omit the porous substrate which is the cause of fiber marks, to reduce the thickness of the porous substrate, or to implement the stencil substantially only with a thermoplastic resin film. However, a stencil with any of such configurations is lower in elasticity than the conventional stencil and therefore apt to jam, e.g., a master making and feeding section. It is to be noted that the stencil implemented substantially only with a thermoplastic resin film also refers to a stencil having a thermoplastic resin film containing a trace of anti-static agent or similar component, and a stencil having a thermoplastic resin film having at least one of opposite major surfaces covered with one or more overcoat layers or similar thin layers.

Japanese Utility Model Laid-Open Publication No. 63-178134, for example, discloses a stencil printer of the type including a document reading section for reading a document image arranged above a master making and feeding section disposed in the printer. This type of stencil printer is capable of reading a document image and making a master at the same time consistently within itself. However, a problem with this type of stencil printer is that a portion for mounting the document reading section must have its mechanical strength, weight and number of parts increased in order to allow the stencil to be set or replaced and allow a jam to be dealt with. This increases the machining cost and cost of assembly of the constituent parts and therefore the overall cost of the printer. Moreover, only a limited space is available for the operator to set or replace the stencil or to deal with a jam, resulting in troublesome work.

To replace or set the stencil in the master making and feeding section or to deal with a master jam or similar jam, it has been customary for the operator to slide the document reading section sideways or open it upwardly so as to provide access from above the reading section. However, sliding or opening the document reading section is not only troublesome to perform, but also causative of the dislocation of the document from its initial position. Specifically, in a document reading section of the type reading a document by moving its scanner relative to the document, vibration ascribable to the reading section slid in a preselected direction in the event of a jam causes the document to move on a glass platen. It is therefore necessary for the operator to open a document table again and set the document on the glass platen correctly. This is also true with a document reading section using an ADF (Automatic Document Feeder) or an RDF (Recycling Document Feeder) or RDH (Recycling Document Handler) for setting a document on a glass platen.

On the other hand, in a document reading section of the type moving a document relative to a stationary scanner, the document is continuously conveyed by, e.g., an ADF to a discharge tray by way of a glass platen and is therefore free from dislocation. However, when a master jams the master making and feeding section, it should be picked out of the master making and feeding section via the top of the section without exception, also resulting in troublesome work. In a conventional stencil printer with such a document reading section, assuming that a trouble occurs in the document reading section, sheet discharging section or sheet feeding section different from the master making and feeding section, and that a jam occurs in the master making and feeding section at the same time. Then, the jam must also be dealt with from above the master making and feeding section, also resulting in troublesome work.

The problems discussed above are particularly true with a stencil printer including a master making and feeding section provided with master stocking means which stocks a perforated part of a stencil or master for a moment.

SUMMARY OF THE INVENTION

It is therefore an object of the present invention to provide a master making device providing the operator with a broader space than a conventional one above or below it at the time of replacement or setting of a stencil or jam processing while allowing a document reading section to remain stationary, and making it needless to increase the mechanical strength, weight or the number of parts of the document reading section, and a stencil printer including the same.

It is another object of the present invention to provide a master making device facilitating the setting or replacement of a stencil and jam processing without causing a document reading section to be moved or causing a document to be dislocated, and a stencil printer including the same.

It is another object of the present invention to provide a master making device allowing the operator to deal with, e.g., a master jam occurred in its master making and feeding section not only from above the master making and feeding section but also in any easy-to-operate direction, and a stencil printer including the same.

It is another object of the present invention to achieve the above objects with a master making device having master stocking means and a stencil printer including the same.

In accordance with the present invention, a master making device for a stencil printer has a document reading section for reading a document image, a master making section for perforating a stencil to thereby make a master, and constituting a master making unit, and a support arrangement for supporting the master making unit such that the master making unit is removable from the body of the stencil printer without the document reading section being displaced relative to the body.

Also, in accordance with the present invention, in a stencil printer including a master making device for perforating a stencil to thereby make a master, a printing section having a drum for wrapping the master therearound, a sheet feeding section for feeding a sheet to the printing section, and a master discharging section for discharging a used master wrapped around the drum, the master making device has a document reading section for reading a document image, a master making section for perforating a stencil to thereby make a master, and constituting a master making unit, and a support arrangement for supporting the master making unit such that the master making unit is removable from the body of the stencil printer without the document reading section being displaced relative to the body.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
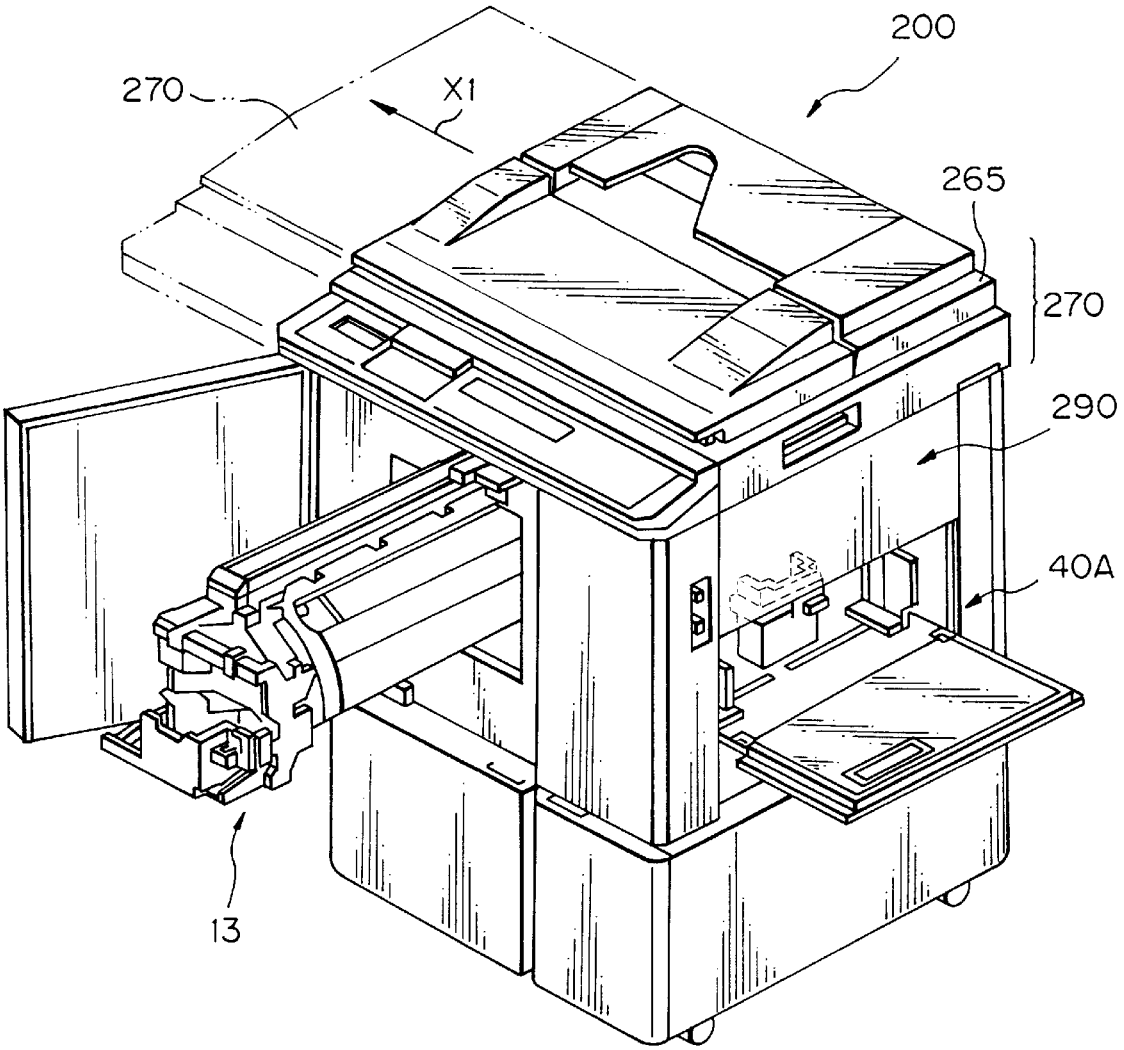
Fig. 1 PRIOR ART
FIG. 1 is a perspective view showing a conventional stencil printer.
Figure 2:
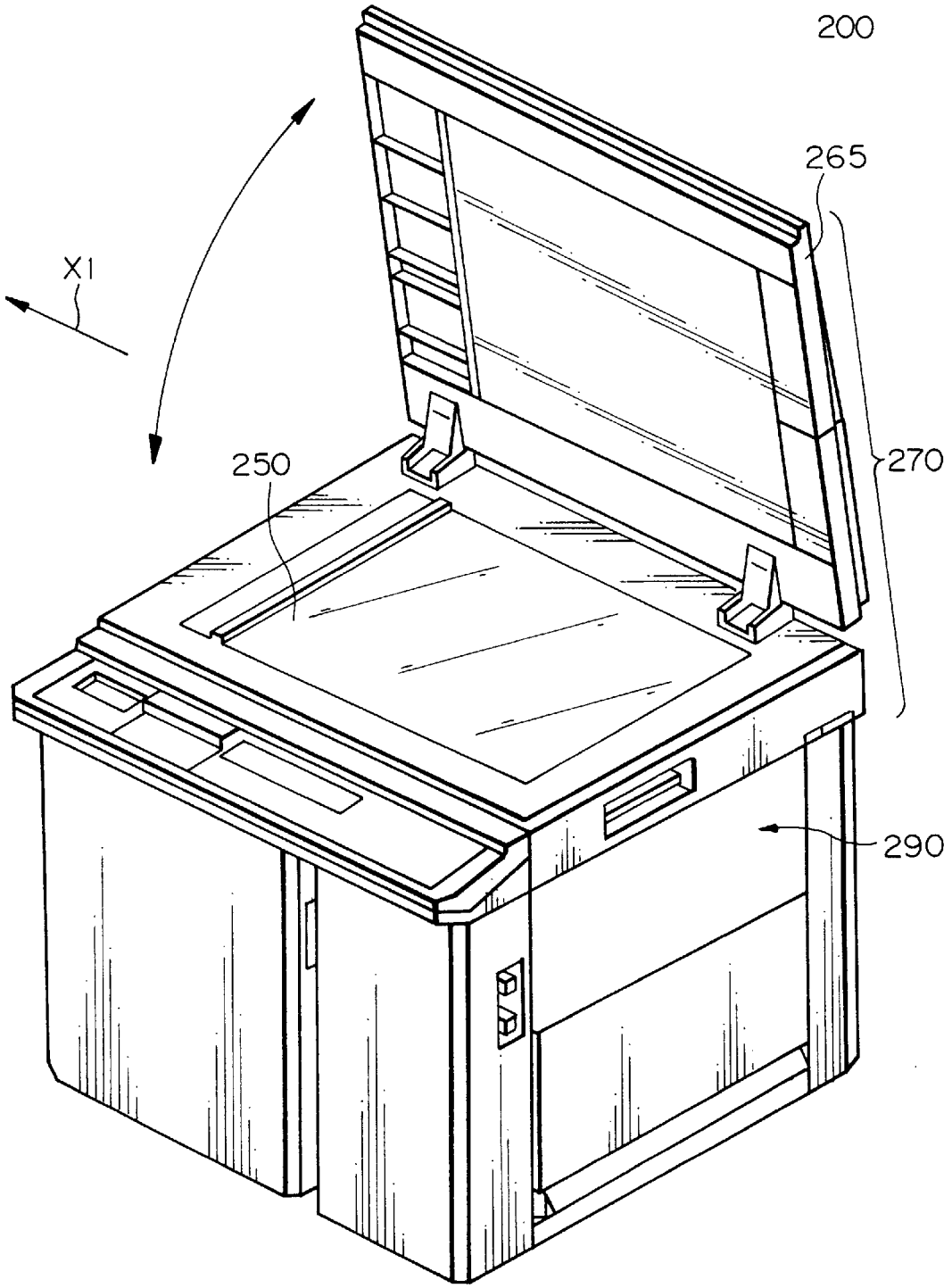
Fig. 2 PRIOR ART
FIG. 2 is a perspective view showing the printer of FIG. 1 with its document table held in an open position.

To better understand the present invention, brief reference will be made to a conventional stencil printer, shown in FIGS. 1 and 2. The stencil printer to be described is of the type having a document reading section above a master making and feeding section arranged within the printer, thereby implementing document reading and master making within the printer consistently. As shown, the printer, generally 200, has a document reading unit 270 mounted on the body thereof. The document reading unit 270, like a conventional unit, includes a scanner movable relative to a stationary document for reading an image out of the document. Specifically, the operator opens a document table 265, lays a document on a glass platen 250, and then closes the document table 265. There are also shown in FIG. 1 a drum unit 13 and a sheet feeding section 40A, and a master making and feeding section 290 arranged below the document reading unit 270. The document reading unit 270 can be slid in the direction indicated by an arrow X1, so that the operator can set or replace a master in the master making and feeding section 290 or remove a stencil or a sheet jamming a path assigned thereto.

Figure 3:
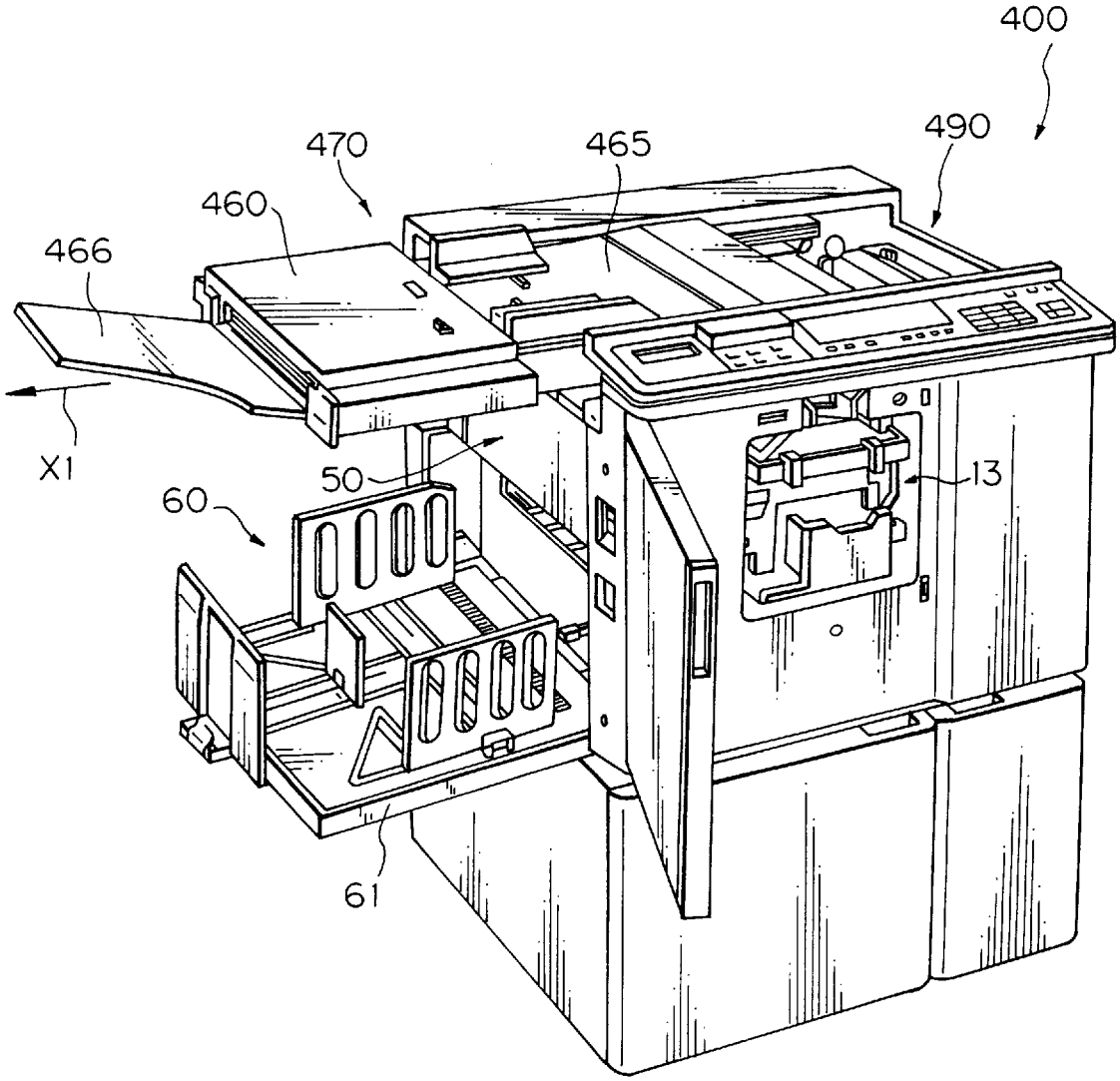
Fig. 3 PRIOR ART
FIG. 3 is a perspective view showing another conventional stencil printer.

FIG. 3 shows another conventional stencil printer which causes a stationary scanner to read a document being moved relative to the scanner. As shown, the stencil printer, generally 400, includes a document reading unit 470. After a document has been set on a document table 465, an ADF 460 automatically conveys the document and discharges it onto a tray 466. A master making and feeding section 490 is arranged below the document reading unit 470. The reading unit 470 can also be slid in the direction indicated by an arrow X1 for the same purpose as the reading section 270 shown in FIG. 1. FIG. 3 shows a condition wherein the reading unit 470 is slid in the direction X1, uncovering the master making and feeding section 490. There are also shown in FIG. 3 a master discharging section 50, a sheet discharging section 60, a tray 61 included in the sheet discharging section 60, and a drum unit 13.

The conventional stencil printers 200 and 400 each has some problems left unsolved, as discussed earlier.

Preferred embodiments of the present invention free from the above problems will be described hereinafter. Some structural elements of each embodiment to be described are not shown in the drawings for clear illustration. As for structural elements provided in pairs, only one of them will be described except when distinction is necessary. Further, identical structural elements included in the embodiments as well as in the conventional stencil printers are designated by identical reference numerals, and a detailed description thereof will not be made in order to avoid redundancy.

1st Embodiment

Figure 4:
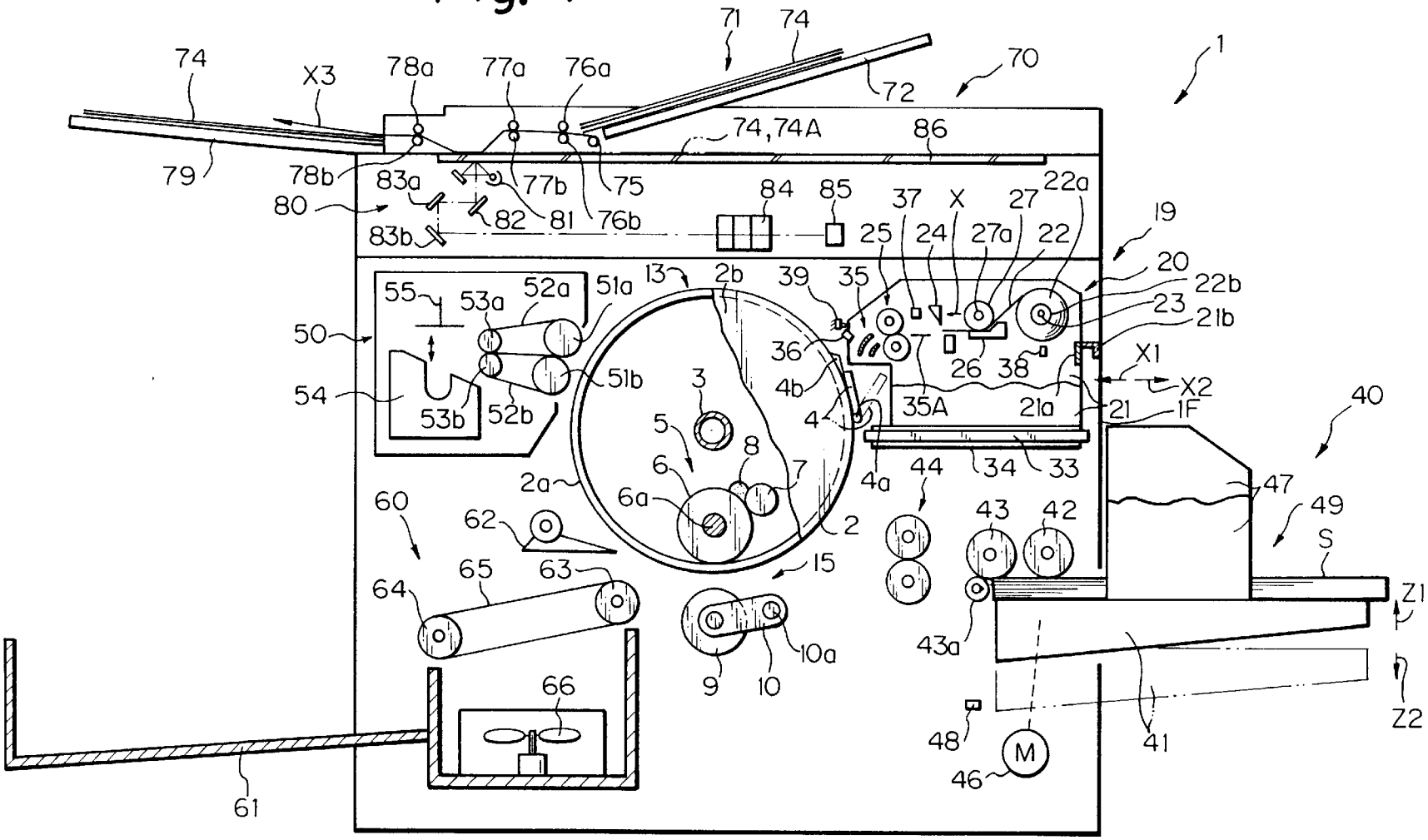
FIG. 4 is a partly sectional front view showing a first embodiment of the stencil printer in accordance with the present invention.

Referring to FIG. 4, a first embodiment of the stencil printer in accordance with the present invention will be described. As shown, the stencil printer, generally 1, includes a frame or body 1F. A glass platen 86 is mounted on the top of the frame 1F while a document 74 (indicated by a phantom line) is to be laid on the glass platen 86. One or more documents may be stacked on a document tray 72. An ADF 71 automatically conveys the documents from the document tray 72 one by one to a preselected position included in a readable range 74A (indicated by a phantom line) assigned to a scanner 80. The scanner 80 is positioned below the glass platen 86 in order to read, over the above range 74A, the document 74 laid on the glass platen 86 by hand or conveyed thereto by the ADF 71. The glass platen 86, ADF 71 and scanner 80 constitute a document reading section 70. A master making and feeding section 19 includes a master making unit 20 and outer rails (only one being visible) 33. The master making unit 20 is removably mounted to one side of the frame 1F below the document reading section 70 in order to perforate, or cut, a stencil 22. The outer rails 33 play the role of support means for guiding and supporting the master making unit 20 removably mounted thereto. A printing section 15 is arranged substantially at the center of the frame 1F and includes a drum 2 around which a perforated part of the perforated stencil, or master, 22 is to be wrapped.

A sheet feeding section 40 is positioned below the master making and feeding section 19 and feeds sheets S stacked on a tray 41 to the printing section 15 one by one. A sheet discharging section 60 is positioned in the lower portion of the frame 1F at the side opposite to the sheet feeding section 40 and includes a tray 61. The sheet discharging section 60 discharges the sheet S with an image printed thereon by the printing section 15, i.e., a printing onto the tray 61. A master discharging section 50 is arranged between the sheet discharging section 60 and the document reading section 70 in order to peel off the used master 22 from the drum 2 and discharge it into a waste master box 54.

The ADF 71 is hinged to the top rear of the frame 1F, as viewed in FIG. 4, so as to be movable or openable away from the glass platen 86. The ADF 71 includes, in addition to the document tray 72, a pick-up roller 75, a pair of separator rollers 76*a* and 76*b*, a pair of upstream conveyor rollers 77*a* and 77*b*, and a pair of downstream conveyor rollers 78*a* and 78*b*. The pick-up roller 75 sequentially feeds the documents 74 stacked on the document tray 72 from the bottom of the stack. The separator rollers 76*a* and 76*b* convey the lowermost document 74 fed by the pick-up roller 75 while separating it from the overlying documents. The upstream conveyor rollers 77*a* and 77*b* convey the document 74 transferred from the rollers 76*a* and 76*b* to the preselected position on the glass platen 86. The downstream conveyor rollers 78*a* and 78*b* drive the document 74 away from the glass platen 86 to a tray 79 in the direction indicated by an arrow X3.

In the scanner 80, a scanning mirror 82 is located below the left portion of the glass platen 86, as viewed in FIG. 4, in order to reflect imagewise light reflected from the surface of the document 74. A pair of mirrors 83*a* and 83*b* are movable at a rate one half of the rate of the scanning mirror 82. A focusing lens 84 has a magnification changing function. An image sensor or photoelectric transducer 85 is implemented as a CCD (Charge Coupled Device) image sensor. A light source 81 is movable integrally with the scanning mirror 82 for illuminating the surface of the document 74. This kind of optics for scanning a document is conventional. When an imagewise reflection is focused on the image sensor 85 via the lens 84, the image sensor 85 outputs a corresponding electric image signal. The image signal is sent to a master making controller, not shown, via an analog-to-digital converter (ADC), not shown, disposed in the frame 1F.

In the illustrative embodiment, the image reading section 70 is affixed to the top of the frame 1F. This is in contrast to the conventional image reading section slidable to the left, as viewed in FIG. 4, or openable about a part thereof.

Figure 5:
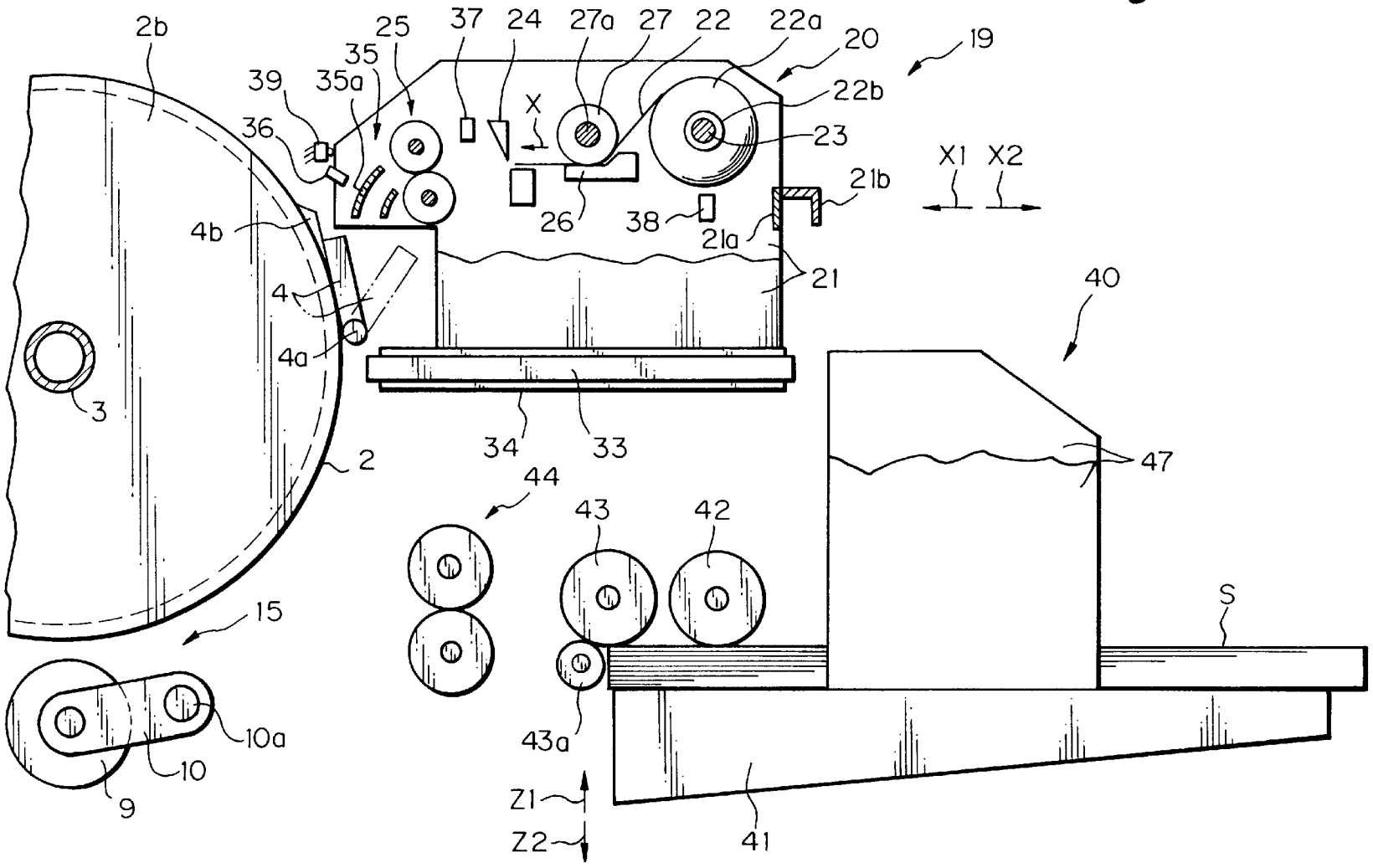
FIG. 5 is a partly sectional enlarged front view of a master making and feeding section and a printing section included in the first embodiment, showing a master making unit held in its mounted or operative position.

As for the master making and feeding section 19, the stencil 22 is assumed to be conveyed from the right to the left, as viewed in FIGS. 4 and 5, in the direction indicated by an arrow X (sometimes referred to as a subscanning direction X). A stencil transport path extends in the above direction X. The right side and left side with respect to the subscanning direction X are sometimes simply referred to as "right" and "left", respectively. Also, the upstream side and downstream side in the direction X are sometimes referred to as "rear" and "front", respectively.

The master making and feeding section 19 will now be described in detail with reference to FIGS. 4–9. As shown, this section 19 includes a unit sensor 39 in addition to the master making unit 20 and outer rails 33. The master making unit 20 has the following configuration. The stencil 22 is implemented as a stencil roll 22*a* supported by a support member or stencil storing means 23. The stencil 22 is paid out from the roll 22*a*, as needed. A third sensor 38 is positioned below the support member 23. A thermal head 26 is located downstream of the support member 23 in the subscanning direction X in order to selectively heat and perforate the stencil 22 paid out from the roll 22*a* in accordance with an image signal. A platen roller 27 is rotatable while pressing the stencil 22 against the thermal head 26, thereby conveying the stencil 22. A cutter or cutting means 24 is interposed between the platen roller 27 and the drum 2 in order to cut the perforated stencil 22 at a preselected length. A pair of conveyor rollers 25 arranged one above the other are positioned between the drum 2 and the cutter 24. A guide plate 35A extends between the cutter 24 and the conveyor rollers 25. A second sensor 37 is interposed between the cutter 24 and the conveyor rollers 25. A pair of guide plates 35 arranged one above the other extend between the drum 2 and the conveyor rollers 25. A first sensor 36 is positioned above the guide plates 35.

The master making unit 20 has a pair of side walls 21 at the right and the left of the stencil transport path. The side walls 21 extend substantially parallel to the subscanning direction X and in an up-and-down direction Z1-Z2. The side walls 21 are firmly connected together by a tie member 21*a* at their inner rear portions. A knob 21*b* is affixed to the rear end of the tie member 21*a*. The operator may grip the knob 21*b* in order to push the master making unit 20 in a forward direction X1 or pull it out in a rearward direction X2. This facilitates the movement of the master making unit 20 into and out of the frame 1F. The side walls 21 and tie member 21*a* each is implemented by a sheet steel subjected to suitable surface treatment. The knob 21*b* is formed of a synthetic resin. Another suitable tie member, not shown, resembling the above tie member 21*a* connects the side walls 21 at a position where it will not interfere with the roll 22*a* to be set or replaced from the above or with the stencil 22 to be removed from above or below in the event of a jam. The tie member 21*a* and knob 21*b* are shown only in FIGS. 4–6.

Figure 9:
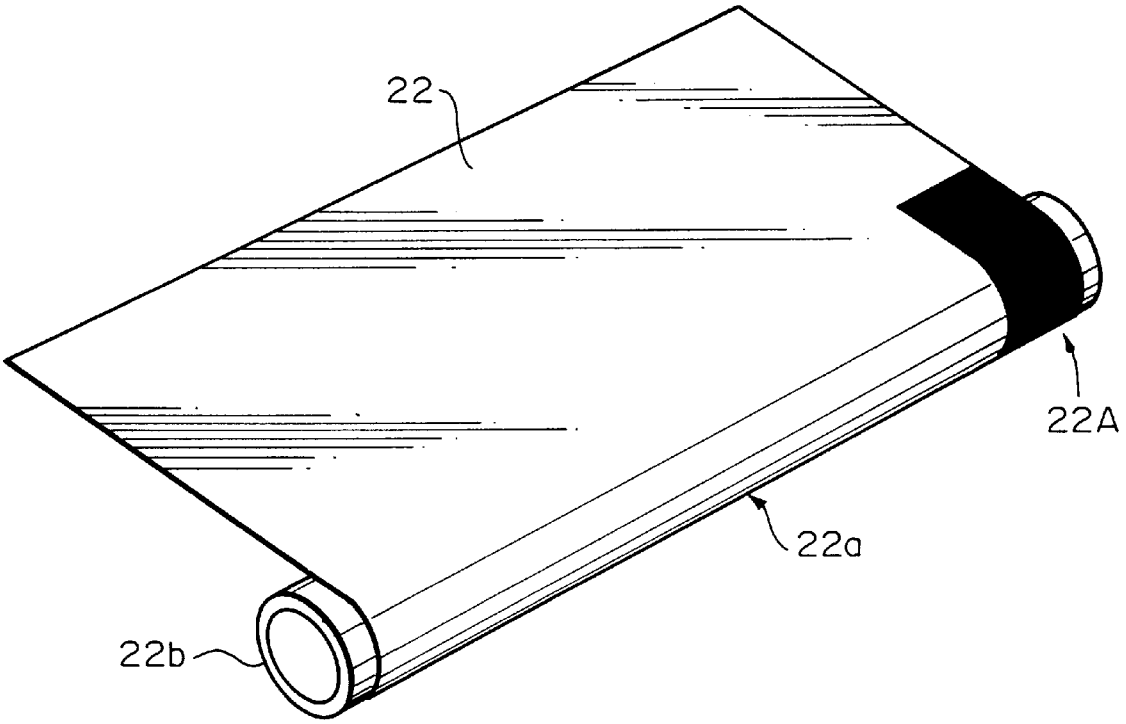
FIG. 9 is a perspective view showing the configuration of a stencil roll also included in the first embodiment.

As shown in FIG. 9 specifically, the stencil 22 is rolled on a tubular core 22*b* protruding from both ends of the roll 22*a*. The stencil 22 has a laminate structure made up of a film of polyester or similar thermoplastic resin and as thin as about 1 $\mu$m to 2 $\mu$m, and a porous substrate adhered to the film. For the porous substrate, use may be made of Japanese paper fibers or synthetic fibers or a mixture thereof. The stencil 22 is perforated by heat selectively generated by the heating elements of the thermal head 26. The support member 23 is so mounted on the side walls 21 as to support both ends of the core 22*b* of the roll 22*a* removably and rotatably. A low reflectance portion 22A extends on the stencil 22 in the rolling direction over a range between the usable limit position and the innermost edge, as illustrated. The low reflectance portion 22A is painted black by way of example.

The thermal head 26 has a plurality of heating elements arranged in the main scanning direction parallel to the axis of a shaft 27*a* on which the platen roller is mounted 27. The heating elements are selectively energized in order to melt and thereby perforate the stencil 22, as well known in the art. Moving means, not shown, selectively moves the head 26 into or out of contact with the platen roller 27. A spring, not shown, is included in the moving means and constantly biases the head 26 toward the platen roller 27.

The platen roller 27 is rotatably supported by the side walls 21 via the shaft 27*a*. A driven gear, not shown, is mounted on the shaft 27*a* and connected to a stepping motor 27M (see FIG. 11) by a drive line including a drive gear, not shown, held in mesh with the driven gear. The platen roller 27 is rotated clockwise, as viewed in FIG. 4, by the stepping motor 27M and conveys the stencil 22 to the downstream side in the subscanning direction X while pressing it against the thermal head 26. A first electromagnetic clutch 27C (see FIG. 11) intervenes between the shaft 27*a* and the above driven gear in order to selectively set up torque transmission from the stepping motor 27M to the platen roller 27 or interrupt it.

The cutter 24 is connected to a cutter motor 24M (see FIG. 11) by a wire and wire pulleys. The cutter 24 is implemented by a conventional rotary edge movable in the widthwise direction of the stencil 22 while being rotated by the cutter motor 24M. While the cutter 24 is out of operation, it is retracted to one side of the stencil transport path so as not to obstruct the conveyance of the stencil 22. If desired, the rotary edge may be replaced with a guillotine type cutter having an upper edge and a lower edge.

The upper conveyor roller or drive roller 25 and lower conveyor roller or driven roller 25 are pressed against each other. The shafts of these rollers 25 are journalled to the side walls 21. The upper roller 25 is connected to the stepping motor 27M by gears or similar drive transmitting means and rotated at a slightly higher peripheral speed than the platen roller 27. As a result, the upper roller 25 applies an adequate degree of tension to the stencil 22 while sliding on the stencil 22. When the first electromagnetic clutch 27C is operated, it transfers the rotation of the stepping motor 27M only to the conveyor rollers 25; the platen roller 27 is brought to a stop.

The guide plates 35 are implemented as an upper and a lower curved plate and affixed to the side walls 21 at their right and left ends. The guide plates 35 steer the leading edge of the stencil 22 perpendicularly downward.

The third sensor 38 is affixed to the rear side wall 21, as viewed in the drawings, via a bracket, not shown, such that it is positioned beneath the roll 22*a* set on the support member 23. The sensor 38 is a reflection type optical sensor made up of a light emitter and a photodetector. The sensor 38 determines the remaining amount of the stencil 22 of the roll 22*a* (and also the usable limit amount of the roll 22*a*) and whether or not the roll 22*a* is present in terms of the varying quantity of reflection from the roll 22*a*. When the stencil 22 is consumed up to its usable limit, the low reflectance portion or black portion 22A of the stencil 22 faces the sensor 38. As a result, the sensor 38 outputs a signal representative of a fall of reflection, i.e., a stencil absent signal. It is to be noted that substantially one turn of the stencil 22 is still available on the roll 22*a* when the sensor 38 senses the low reflectance portion 22A during master making operation.

Figure 6:
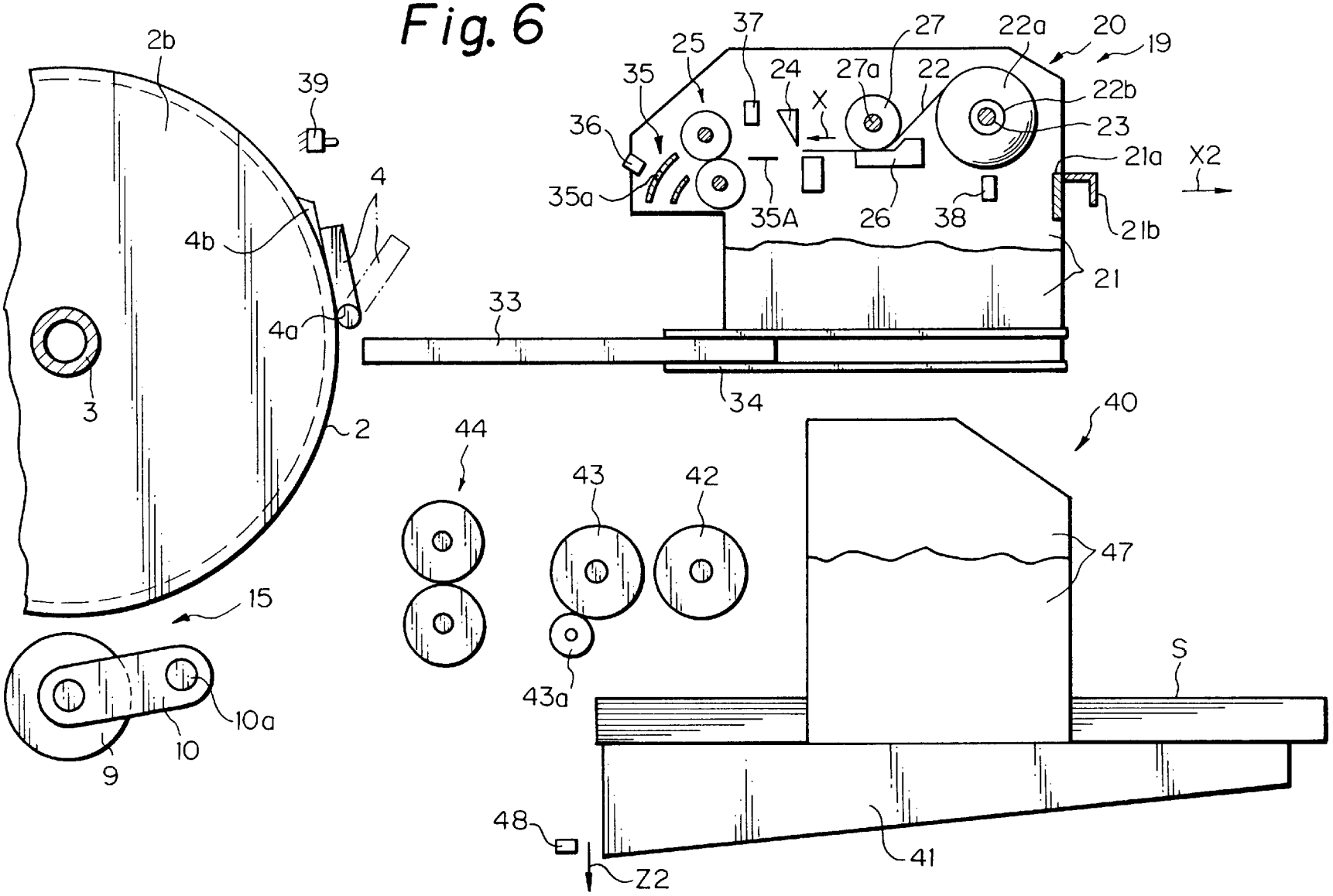
FIG. 6 is a view similar to FIG. 5, showing the master making unit held in its inoperative position pulled out of the printer body.

The second sensor 37 and first sensor 36 each are affixed to the rear side wall 21, as viewed in the drawings, via a respectively bracket, not shown, and also implemented as a reflection type optical sensor made up of a light emitter and a photodetector. The second sensor 37 determines whether or not the stencil 22 is being conveyed, i.e., whether or not a defective stencil transport or stencil jam has occurred. The first sensor 36 determines whether or not the stencil 22 has jammed the path between the master making unit 20 and the drum 2. As shown in FIGS. 5 and 6, the upper guide plate 35 facing the first sensor 36 is formed with an opening 35*a* for passing light issuing from the light emitter toward the photodetector.

Figure 8:
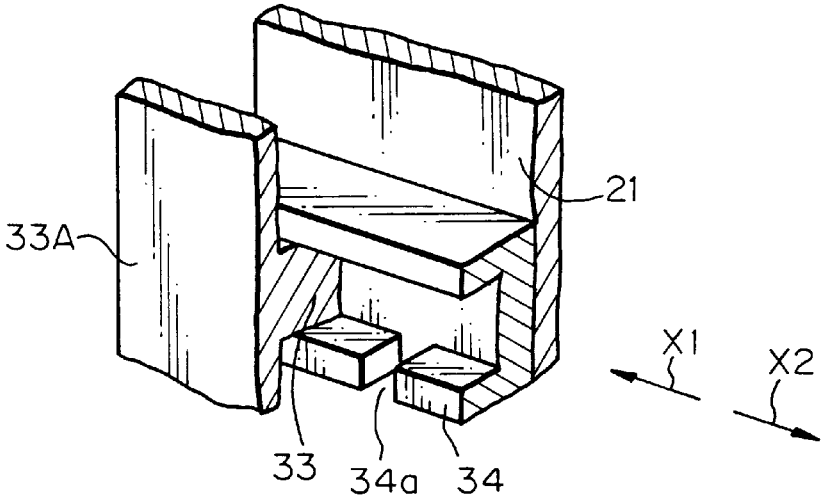
FIG. 8 is a fragmentary perspective view of support means also included in the first embodiment.

As shown in FIG. 8 in detail, one inner rail 34 is affixed to each of the opposite side walls 21. The inner rails 34 of the side walls 21 are positioned back to back, as illustrated. The outer rails 33 each are rectangular and affixed to the lower portion of one of opposite side walls 33A included in the frame 1F. One of the side walls 33A is partly shown only in FIG. 8. The outer rails 33 each are received in the channel-like recess of the respective inner rail 34, so that the master making unit 20 is bodily removable from the frame 1F. Specifically, because the inner rails 34 are movably guided by the outer rails 33, the master making unit 20 is movable over a preselected range in directions X1 and X2 parallel to the subscanning direction X. More specifically, the master making unit 20 is slidable into the frame 1F to an operative position shown in FIGS. 4 and 5 or out of the frame 1F to an inoperative position shown in FIG. 6. In the operative position, the stencil 22 is ready to be paid out from the roll 22*a* and conveyed toward the drum 2. In the inoperative position, the roll 22*a* can be set or replaced or a jam can be dealt with, as desired. The inoperative position includes a position where the master making unit 20 is pulled out to a position outside the master making and feeding section 19.

In the illustrative embodiment, all of the stepping motor 27M, cutter motor 24M and first electromagnetic clutch 27C are mounted on the master making unit 20. These motors and actuators are connected to a controller 90, which will be described with reference to FIG. 11, and a power source by flexible signal cables and power cables via connectors. The controller 90 is located at a suitable position on the frame 1F. Therefore, the master making unit 20 can be connected or disconnected from the printer body only if the connectors are connected, i.e., without resorting to any special drive transmission mechanism. Likewise, the thermal head 26 of the unit 20 is connected to the previously mentioned master making controller and power source by a flexible signal cable and power cable via an exclusive connector so as to receive the image signal and power. This is also true with the various sensors mounted on the master making unit 20 and the controller 90 and power source.

Figure 7:
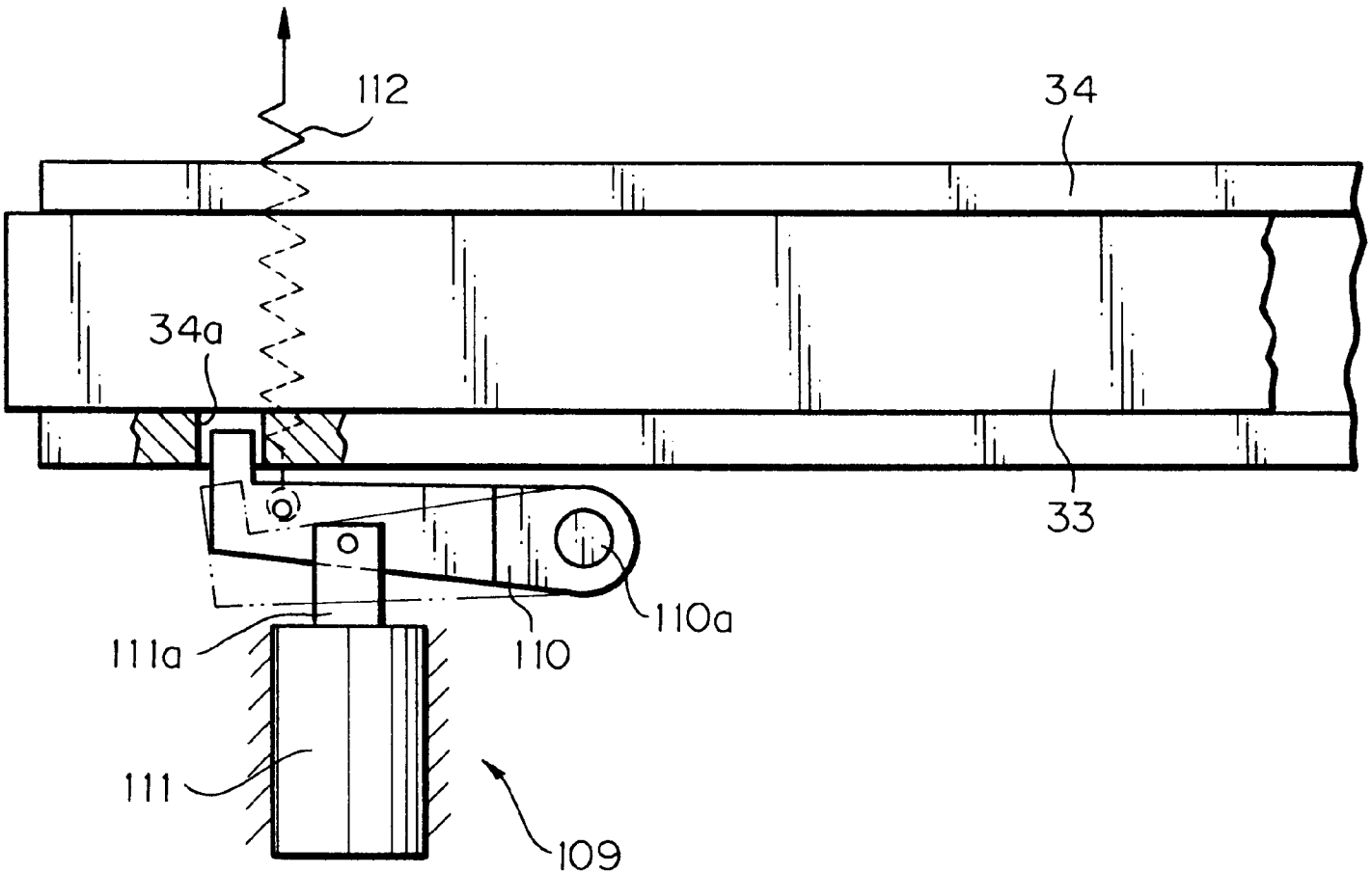
FIG. 7 is a fragmentary partly sectional view of means included in the first embodiment for locking the master making unit.

FIG. 7 shows second restricting means 109 including a stop or locking member 110 and a solenoid or locking member drive means 111. The stop 110 is movable between a locking position (solid line in FIG. 7) for preventing the master making unit 20 from moving relative to the printer body and an unlocking position (i.e. the phantom line position in FIG. 7) for allowing the former to move relative to the latter. The solenoid 111 drives the stop 110 to the locking position or the unlocking position, as needed.

As shown in FIGS. 7 and 8, a lower flange included in the front inner rail 34 is formed with a notch 34*a* in the vicinity of the front end of the rail 34. A shaft 110*a* (shown only in FIG. 7) is studded on the lower portion of the side wall 33A in the vicinity of the front end of the rail 33. The stop 110 having a hook-like configuration is rotatably mounted on the shaft 110*a*.

The solenoid 111 having a plunger 111*a* is fixed in place in the vicinity of the side wall 33A on which the shaft 110*a* is studded. The free end of the stop 110 is slightly tapered so as to be capable of entering the notch 34*a* of the inner rail 34 easily. The plunger 111*a* is connected to the intermediate portion of the stop 110. A tension coil spring 112 is anchored at one end to the free end of the stop 110 and at the other end to a retainer, not shown, studded on the upper portion of the side wall 33A. The coil spring or biasing means 112 constantly biases the stop 110 clockwise, as viewed in FIG. 7, such that the free end of the stop 110 tends to enter the notch 34*a*.

The above arrangement may be provided on the rear outer rail 33 and rear inner rail 34, if desired. Further, the second restricting means 109 may be implemented by a push rod movable into and out of the notch 34*a*, a positive motion cam for moving the push rod between a locking position and an unlocking position, and a motor for causing the cam to rotate.

When the master making unit 20 is brought to its operative position, the stop 110 and coil spring 112 cooperate to position the unit 20 in the front-and-rear direction X1-X2. Pins, not shown, are studded on the front end faces of the side walls 21 in order to position the master making unit 20 in the right-and-left direction perpendicular to the above direction. In the up-and-down direction Z1-Z2, the master making unit 20 is positioned by the inner rails 34 and outer rails 33 engaged with each other.

The unit sensor 39 is implemented by a microswitch by way of example. The unit sensor 39 is affixed via a bracket to a preselected position on the rear portion, as viewed in the drawings, of the side wall 33A constructed integrally with the outer rail 33. While the inner rail 34 moves along the outer rail 33, the front end face of the rear side wall 21, as viewed in the drawings, formed integrally with the inner rail 34 presses the microswitch. As a result, the microswitch determines that the master making unit 20 is brought to its operative position.

The printing section 15 consists mainly of the drum 2 and a press roller or pressing means 9. The drum 2 is rotatable clockwise, as viewed in FIG. 4, about a shaft 3 by being driven by a main motor via gears or similar drive transmission system, although not shown specifically. The press roller 9 is movable into and out of contact with the drum 2.

The drum 2 is made up of a porous hollow cylinder formed of resin or metal, a plurality of mesh screens, not shown, formed of resin or metal and covering the cylinder in a laminate structure, and a left and a right flange 2*b* affixed to both ends of the cylinder. Ink feeding means 5 is arranged in the drum 2. The ink feeding means 5 is made up of an ink roller 6, a doctor roller 7, and an ink pipe 3. The ink roller 6 feeds ink to the inner periphery of the drum 2. The doctor roller 7 is parallel to and slightly spaced from the ink roller 6 so as to form a wedge-like ink well 8 between it and the ink roller 6. The ink pipe 3 feeds the ink to the ink well 8 while serving as the shaft 3 at the same time.

The ink roller 6 is mounted on a shaft 6*a* journalled to side walls, not shown, affixed to the ink pipe 3. The rotation of the main motor to be transmitted to the drum 2 is partly transmitted to the ink shaft 6*a* via drive transmitting means including gears and a belt, not shown. Therefore, the ink roller 6 is rotatable in the same direction as and in synchronism with the drum 2. The ink in the ink well 8 is deposited on the ink roller 6 in the form of a thin layer while being regulated in amount by the doctor roller 7. An ink feeding device, not shown, sucks the ink from an ink pack or similar ink reservoir, not shown, located outside of the drum 2. The ink is dropped into the ink well 8 via holes formed in the ink pipe 3.

A stage 4*b* is mounted on a non-porous portion forming a part of the circumferential surface of the drum 2. The stage 4*b* extends along a line parallel to the axis of the drum 2 and is formed of a ferromagnetic material. A damper 4 is rotatably mounted on the non-porous portion of the drum 2 via a shaft 4*a* in parallel with the stage 4*b* in order to clamp the leading edge of the perforated part of the stencil, or master, 22. The damper 4 is provided with a rubber magnet. When the drum 2 is rotated to its preselected position, the damper 4 is rotated toward or away from the stage 4*b* by opening/closing means, not shown, mounted on the frame 1F. In the drawings, the damper 4 is shown in a slightly enlarged scale and, of course, does not interfere with members arranged around the drum 2.

A master sensor 14 (shown only in FIG. 11) is associated with the damper 4 and stage 4*b* in order to determine whether or not they have clamped the leading edge of the master 22. For the master sensor 14, use is made of a master sensor 40 shown in, e.g., FIG. 5 of Japanese Patent Laid-Open Publication No. 6-270527. Specifically, the master sensor 14 determines whether or not the master 22 is present on the basis of electric conduction between the clamper 4 and the stage 4*b* via the leading edge portion of the master 22 which is not perforated.

The drum 2, ink feeding means 5 including the ink pipe 3, ink pack and so forth constitute the drum unit 13. The drum unit 13 is removably mounted to the printer body via retaining means arranged on the frame 1F. The drum unit 13 and retaining means therefor are similar to a drum unit and retaining means shown in, e.g., FIGS. 2, 3 and 7 of Japanese Patent Laid-Open Publication No. 5-229243 and will not be shown or described specifically.

In this embodiment, the drum unit 13 is inserted to the rear, as viewed in FIG. 4, or pulled out to the front as viewed in FIG. 4. When the drum unit 13 is pulled out to the front, a so-called stop mechanism temporarily stops the unit 13 just before it is fully dismounted from the apparatus body. For the stop mechanism, use may be made of an arrangement taught in Japanese Patent Application No. 8-264619. When the drum unit 13 is temporarily stopped by the above stop mechanism, it prevents a cut piece of the stencil 22 forcibly driven out of the master making unit 20 by the conveyor rollers 25 from contacting the outer periphery of the drum 2, as will be described specifically later.

A drum sensor, not shown, is mounted on the frame 1F at a preselected position on the path along which the drum unit 13 is movable into and out of the printer body. The drum sensor determines whether or not the drum unit 13 is held in the above position by the stopping mechanism. The drum sensor may be implemented by a microswitch engageable with a part of the drum 2. A connector, not shown, assigned to the power source portion of the drum unit 13 is positioned at the rear of the printer body. This allows the pulling-out of the drum unit 13 to be determined on the basis of the OFF state of a signal output from the power source portion.

The press roller or pressing means 9 is positioned below the drum 2 and movable into and out of contact with the drum 2. The press roller 9 has its shaft rotatably supported by a right and a left press roller arm 10. The press roller arms 10 each is affixed to a shaft 10*a* at one end remote from the press roller 9. the shaft 10*a* is journalled to the side walls 33A. In this condition, the press roller 9 is rotatably supported by the free ends of the press roller arms 10 which are angularly movable about the shaft 10*a*. A cam follower, not shown, is mounted on one end of the shaft 10*a*. A cam, not shown, is mounted on the side wall 33A adjoining the cam follower and rotatable in synchronism with the drum 2. The press roller 9 is selectively released from the drum 2 on the basis of the relation between the cam and the cam follower contacting each other. A spring or similar biasing means, not shown, constantly biases the press roller 9 toward the drum 2. When the sheet S is not transported, the press roller 9 is held in its position released from the drum 2 by retaining means, not shown, including a spring, a retaining member, and a solenoid. The press roller 9 playing the role of the pressing means may be replaced with a conventional press drum, if desired.

The sheet feeding section 40 includes a right and a left side fence 47, a pick-up roller 42, a separator roller 43, a reverse roller 43*a*, an upper and a lower registration roller 44, a tray motor or tray drive means 46, and a tray sensor 48. As shown in FIG. 4, the sheet tray 41 and tray motor 46 constitute first restricting means 49. The tray motor 46 causes the sheet tray 41 to move up and down between a restricting position (shown in FIGS. 4 and 5) where the tray 41 prevents the master making unit 20 from moving out of the printer body and an unrestricting position (shown in FIG. 6) where it allows the unit 20 to move out of the printer body.

The tray 41 is positioned below the master making unit 20 and movable up and down relative to the frame 1F. When the tray 41 is brought to the restricting position, its side fences 47 abut against the master making unit 20. An elevating mechanism similar to an elevating mechanism 170 shown in, e.g., FIGS. 6 and 7 of Japanese Patent Laid-Open Publication No. 7-125855 selectively moves the tray 41 upward (arrow Z1) or downward (arrow Z2), although not shown or described specifically.

The tray 41, like a conventional sheet tray, is positioned close to the master making and feeding section 19 in order to reduce the size of the printer. The side fences 47 stand upright on the tray 41 outside of the printer body so as not to collide with the structural members of the master making and feeding section 19, e.g., the inner rails 34 of the master making unit 20 within the printer body.

More specifically, as shown in FIGS. 4 and 5, the side fences 47 are configured and positioned such that when the tray 41 is held in the restricting position where the tray sensor 48 does not sense it, the upper front ends of the side fences 47 respectively interfere with the inner rails 34 of the master making unit 20, preventing the unit 20 from being pulled out in the direction X2. As shown in FIG. 6, when the tray 41 is brought to the restricting position where the tray sensor 48 senses it, the side fences 47 do not interfere with the inner rails 34 and allow the master making unit 20 to be pulled out in the direction X2. The side fences 47, of course, serve to position the sheet stack S on the sheet tray 41 in the widthwise direction of the stack S.

The pick-up roller 42 and separator roller 43 are positioned on the top sheet S and rotated by a sheet feed motor, not shown, via drive transmitting means including pulleys and an endless belt, not shown. A sensor, not shown, is located in the vicinity of the pick-up roller 42 in order to determine whether or not the top sheet S has been brought into contact with the roller 42 due to the elevation of the tray 41 (direction Z1). The pick-up roller 42 pays out the top sheet S while the separator roller 43 and reverse roller 43*a* cooperate to separate the top sheet S from the underlying sheets.

The tray sensor 48 is mounted on the lower portion of the side wall 33A and implemented by a reflection type optical sensor. The sensor 48 is responsive to the unrestricting position of the tray 41 mentioned earlier. A reflection surface for reflecting light issuing from the above optical sensor is provided on the lower portion of the tray 41. If desired, the sensing means responsive to the unrestricting position of the tray 41 may be implemented by a transmission type optical sensor mounted on the side wall 33A and a plate mounted on the tray 41 for intercepting light issuing from the sensor.

The registration rollers 44 are located downstream of the separator roller 43 and reverse roller 43*a* in the direction of sheet transport. The registration rollers 44 drive the leading edge of the sheet S fed from the tray 41 toward the drum 2 and press roller 9 at a preselected timing. A pair of guides, not shown, extend between the separator roller 43 and reverse roller 43*a* and the drum 2 and press roller 9.

The sheet discharging section 60 includes a tray 61, a peeler 62, an inlet roller 63, an outlet roller 64, a belt 65 passed over the rollers 63 and 64, a suction fan 66, a roller motor, not shown, and a fan motor, not shown. The peeler 62 is positioned such that its free end is angularly movable in the vicinity of the drum 2 in order to peel off the sheet or printing S from the drum 2. The inlet roller 63 and outlet roller 64 are journalled to the side walls 33A. The belt 65 passed over the rollers 63 and 64 is formed with a plurality of openings. When the outlet roller 64 is rotated by the roller motor, its rotation is transferred to the inlet roller 63 via the belt 65. The suction fan 66 is mounted on the lower portion of the side walls 33A between the rollers 63 and 64 and rotated by the fan motor (not shown). The suction fan 66 in rotation generates a stream of air flowing downward, as viewed in FIG. 4, thereby retaining the sheet S on the surface of the belt 65.

The master discharging section 50 includes an upper and a lower peel roller 51*a* and 51*b*, an upper and a lower discharge roller 53*a* and 53*b*, a pair of belts 52*a* and 52*b*, and a compressing plate 55. The belt 52*a* is passed over the peel roller 51*a* and discharge roller 53*a* while the belt 52*b* is passed over the peel roller 51*b* and discharge roller 53*b*. The peel rollers 51*a* and 51*b* are movable toward the drum 2 by being moved by a moving mechanism while being rotated by a master discharge motor.

When the peel rollers 51*a* and 51*b* are moved toward the drum 2 while being rotated, they contact a used master wrapped around the drum 2 via the associated belts 52*a* and 52*b* and peel it off. The discharge rollers 53*a* and 53*b* discharge the used master peeled off from the drum 2 and conveyed by the belts 52*a* and 52*b* into the waste master box 54. The compressing plate 55 is movable up and down by being driven by an elevating mechanism including a plate motor, not shown, so as to compress the used master collected in the box 54. This allows a great number of used masters to be accommodated in the box 54.

Figure 10:
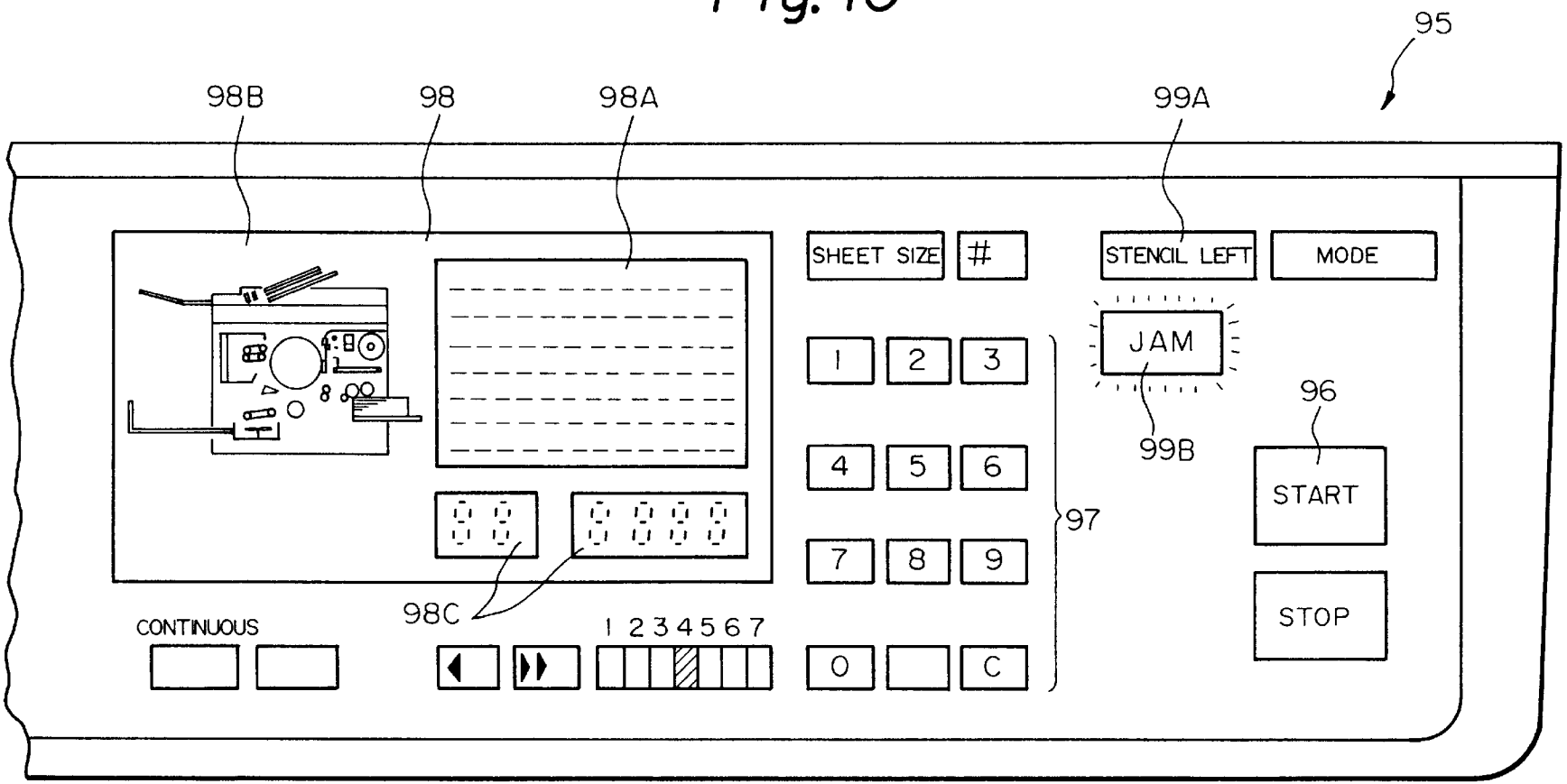
FIG. 10 is a fragmentary plan view showing a specific configuration of an operation panel also included in the first embodiment.

FIG. 10 shows a specific configuration of an operation panel 95 mounted on the top of the document reading section 70 for the operation of the printer 1. As shown, the operation panel 95 includes numeral keys 97 for inputting a desired number of printings (or copies) to be produced with one or more documents 74 and the number of documents. A start key 96 is used to start a sequence of steps of master making and feeding, trial printing, and actual printing. A liquid crystal display (LCD) 98 for informing the operator of an action to take either in response to a master jam or a sheet jam. A lamp 99A is turned on when the stencil 22 on the support member 23 reaches its usable limit amount. A lamp 99B is turned on when a master jam occurs in the master making unit 20 or on the drum 2.

The LCD 98 has a guidance area 98A and an auxiliary area 98B. The guidance area 98A informs the operator of an action to take, displays an alarm message if an action taken is inadequate, and displays characters representative of a location where a stencil jam or a sheet jam has occurred. The auxiliary area 98B sequentially displays in graphics, the contents of actions indicated by the guidance area 98A and displays the location or both the location and the content of a stencil jam or a sheet jam. A seven-segment LED (Light Emitting Diode) display device 98C is arranged in the lower portion of the guidance area 98A, as viewed in FIG. 10, in order to display the number of printings and that of documents input on the numeral keys 97.

Figure 11:
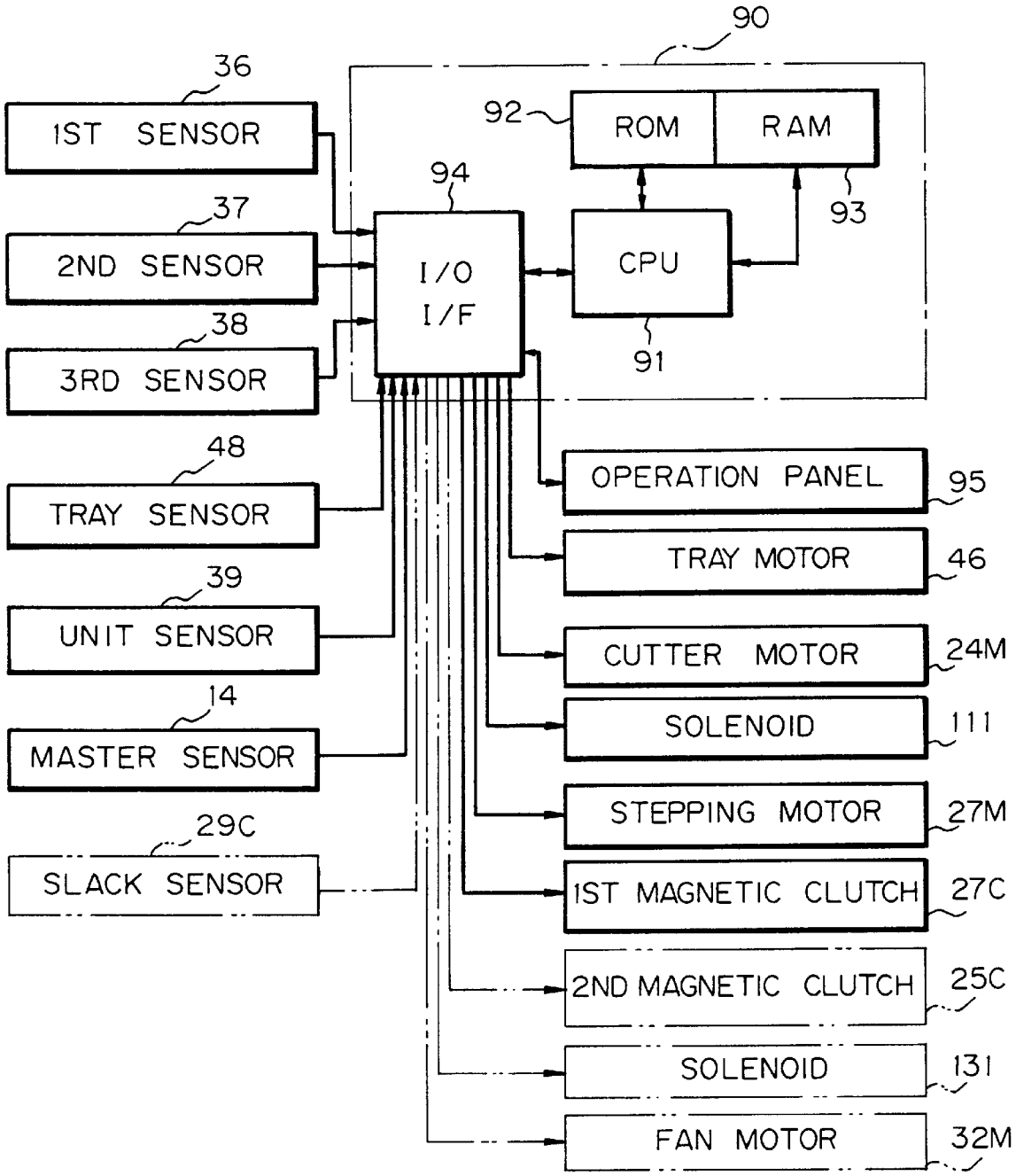
FIG. 11 is a block diagram schematically showing a control system also included in the first embodiment.

Reference will be made to FIG. 11 for describing a control system particular to the illustrative embodiment. As shown, the control system includes a controller or control means 90 for interchanging command signals, ON/OFF signals and data signals with the first to third sensors 36-38, tray sensor 48, unit sensor 39, master sensor 14, operation panel 95 including the keys, lamps and displays, stepping motor 27M included in the master making unit 20, first electromagnetic clutch 27C, cutter motor 24M and solenoid 111 via drivers and suitable electronic circuits. The controller 90 controls the previously mentioned main motor in addition to the various sections of the master making and feeding section 19 except for the thermal head 26.

The controller 90 is implemented as a microcomputer including a CPU (Central Processing Unit), an I/O (Input/Output) port and I/F (Interface) 94, a ROM (Read Only Memory) 92 and a RAM (Random Access Memory) 93 interconnected by a signal bus, not shown. The RAM 93 temporarily stores the results of calculation output from the CPU 91 and stores the ON/OFF signals and data signals received from the sensors and keys. The ROM 92 stores a program and data beforehand which are used to execute unique control which will be described later. The program and data may be set by being written to the ROM 92 beforehand or by the replacement of a ROM chip.

Briefly, the controller 90 of this embodiment executes the following three different kinds of control. First, in response to the stencil absent signal output from the third sensor 38, the controller 90 controls the solenoid 111 of the second restricting means 109 so as to hold the stop 110 at its locking position until the controller 90 moves the sheet tray 41 to its unrestricting position via the tray motor 46 of the first restricting means 49.

Second, in response to a defective transport signal output from the second sensor 37 and/or a defective transport signal output from the first sensor 36, each showing that the stencil 22 has not moved away from the sensor within a preselected period of time, the controller 90 determines that a stencil jam has occurred. Then, the controller 90 holds the stop 110 at its locking position via the solenoid 111 until the controller 90 moves the sheet tray 41 to its unrestricting position via the tray motor 46.

Third, assuming that when or after the damper 4 of the drum 2 has clamped the perforated stencil or master 22 or when the drum 2 completes a predetermined angular movement (one full rotation in the embodiment), the master sensor 14 outputs a defective transport signal (master absent signal representative of the absence of the master 22), or the second sensor 37 and/or the first sensor 36 outputs a defective transport signal (master present signal representative of the presence of the master 22). Then, the controller 90 determines that a stencil jam has occurred, and controls the solenoid 111 to hold the stop 110 in its locking position until it moves the sheet tray 41 to its unrestricting position via the tray motor 46. Subsequently, the controller 90 causes the cutter 24 to cut the trailing edge of the master 22 via the cutter motor 24M. Thereafter, the controller 90 controls the stepping motor 27M and first electromagnetic clutch 27C such that the conveyor rollers 25 drive the master 22 cut off to the outside of the master making unit 20.

The control unique to the illustrative embodiment will be described specifically with reference to FIGS. 4–11.

Assume that at the time of power-up of the printer the third sensor 38 sends the stencil absent signal (OFF signal) to the controller 90, or that the sensor 38 outputs it on detecting the usable limit of the roll 22*a* ascribable to repeated master making operation. When the stencil 22 is absent, the controller 90 turns on the lamp 99A of the operation panel 95 immediately and urges the operator to set a new roll 22*a* via the guidance area 98A and auxiliary area 98B of the LCD 98. When the stencil 22 is short, the controller 90 allows the master making operation under way to be completed because at least one turn of the stencil 22 is still available, and then turns on the lamp 99A and urges the operator to replace the roll 22*a* via the guidance area 98A and auxiliary area 98B.

The controller 90 determines, based on the output of the tray sensor 48, whether or not the sheet tray 41 is lower than its unrestricting position. If the tray 41 is higher than the unrestricting position, the controller 90 drives the tray motor 46 in order to lower the tray 41 to the unrestricting position. When the tray 41 reaches the unrestricting position, as determined by the sensor 48, the controller 90 operates the second restricting means 109 in order to allow the master making unit 20 to be pulled out of the printer body. Specifically, the controller 90 energizes the solenoid 111 and thereby causes it to pull the plunger 111*a* against the action of the tension coil spring 112. As a result, the free end of the stop 110 is rotated counterclockwise, as viewed in FIG. 7, out of the notch 34*a* of the inner rail 34 to its unlocking position. In this condition, the master making unit 20 is ready to be pulled out of the printer body.

As the operator pulls the master making unit 20 out of the printer body, the unit sensor 39 sends an OFF signal to the controller 90. The operator removes the roll 22*a* reached its usable limit from the support member 23 and then sets a new roll 22*a* on the support member 23. The controller 90 determines whether or not the new roll 22*a* is adequately set on the basis of whether or not the third sensor 38 turns on. When the new roll 22*a* is adequately set, as determined by the sensor 38, the controller 90 turns off the lamp 99A and causes the adequate information on the guidance area 98A and auxiliary area 98B to disappear. If the third sensor 38 does not turn on even after a preselected period of time, the controller 90 determines that the new roll 22*a* is not adequately set on the support member 23 or that the used roll 22*a* is left on the support member 23. In this case, the controller 90 displays such a condition on the LCD 98 while alerting the operator via a buzzer or similar alerting means.

When the operator pushes the master making unit 20 loaded with the roll 22*a* into the printer body, the unit sensor 39 sends its output representative of the presence of the unit 20 to the controller 90. In response, the controller 90 again operates the second restricting means 109. Specifically, the controller 90 deenergizes the solenoid 111 with the result that the free end of the stop 110 is rotated clockwise, as viewed in FIG. 7, by the coil spring 112 into the notch 34*a*. Consequently, the stop 110 locks the master making unit 20 in the printer body and causes it to wait for the following master making operation.

When the operator presses (ON) the start key 96, the controller 90 causes a sequence of steps of document reading, master making, master feeding, trial printing and sheet discharging to be executed in response to the output of the key 96. First, when the drum 2 with a used master wrapped therearound is rotated to a preselected master discharge position where it faces the peel roller 51*b*, the peel roller 51*b* is moved toward the drum 2 while being rotated together with the other peel roller 51*a* and discharge rollers 53*a* and 53*b*. When the peel roller 51*b* is brought into contact with the used master via the belt 52*b*, the drum 2 is sill rotating counterclockwise, as viewed in FIG. 4. As a result, the used master is peeled off by the peel roller 51*b* via the belt 52*b* and then nipped by the peel roller 51 and discharge rollers 53 via the belts 52*a* and 52*b*. The peel roller 51 and discharge rollers 53 convey the used master while sequentially separating it from the drum 2. The used master fully separated from the drum 2 is collected in the waste master box 54. Then, the compressing plate 55 is lowered to compress the used master in the box 54.

At the same time, the controller 90 drives the tray motor 46 in order to raise the sheet tray 41 for preparing it for the printing step. The elevation of the tray 41 is stopped when the top sheet S on the tray 41 presses itself against the pick-up roller 42 with a preselected pressure.

After the removal of the used master from the drum 2, the drum 2 is further rotated and then brought to a stop at a master feed position where the damper 4 is positioned substantially just at the right of the drum 2. Then, the opening/closing means opens the damper 4 to the phantom line position shown in FIG. 4. In such a position, the drum 2 waits for the master 22. This is the end of the master discharging step.

In parallel with the above master discharging step, the document reading step and master making step are executed, as follows. In the illustrative embodiment, assume that when the drum 2 is held in the above master waiting position, the leading edge of the stencil 22 is positioned on the lower or stationary edge of the cutter 24, as shown in FIGS. 4–6. A sensor, not shown, responsive to the leading edge or the stencil 22 held at such a waiting position is located above the stationary edge. With this sensor, it is possible to determine whether or not the leading edge of the stencil 22 is located at the waiting position when the stencil 22 is cut off by the cutter 24 after the master making step or when the stencil 22 is set for the first time.

The ADF 71 automatically feeds the bottom document 74 from the document tray 72 to the preselected position on the glass platen 86. The scanner 80 is driven to read an image out of the above document 74, as follows. While the light source 81 illuminates the document 74, the resulting reflection from the document 74 is incident to the image sensor 85 via the scanning mirror 82, mirrors 83*a* and 83*b*, and lens 84. The image sensor or photoelectric transducer 85 outputs a corresponding electric signal and feeds it to the ADC.

In parallel with the operation of the scanner 80, the heating elements arranged in an array on the thermal head 26 are selectively energized in accordance with a digital image signal output via the ADC and master making controller, while being operated in the main scanning direction. As a result, the thermosensitive resin film of the stencil 22 pressed against the platen roller 27 by the head 26 is selectively perforated by heat. At the same time, the platen roller 27 driven by the stepping motor 27M conveys the stencil 22 to the downstream side in the subscanning direction X. Also, the conveyor rollers 25 are rotated to convey the stencil 22 to the downstream side in the direction X while the guide plates 35 guide the stencil 22. At this instant, the first magnetic clutch 27C is held in its ON state and transmits the rotation of the stepping motor 27M to the platen roller 27. A timer built in the controller 90 starts counting time when the stepping motor 27M starts rotating at the beginning of the master making step. The controller 90 compares the time being counted by the timer with a preselected period of time for transport stored in the ROM 92 beforehand.

Assume that while the perforated stencil 22 is conveyed in the above master making step, it does not move away from the position where the second sensor 37 or the first sensor 36 is located within the above period of time stored in the ROM 92. Then, the controller 90 determines that a stencil jam has occurred in response to the resulting output of the sensor 37 or 26. In this case, the controller 90 turns on the lamp 99B of the operation panel 95 and causes the LCD 98 to display a stencil jam message and the location of the jam in its guidance area 98A and auxiliary area 98B, respectively. At the same time, the controller 90 stops the rotation of the stepping motor 27M and therefore the rotation of the platen roller 27 and conveyor rollers 25, thereby interrupting the master making operation. Subsequently, in response to the output of the tray sensor 48, the controller 90 determines whether or not the sheet tray 41 is higher than the unrestricting position. If the tray 41 is higher than the unrestricting position, the controller 90 lowers the tray 41 to the unrestricting position via the tray motor 46.

Subsequently, the controller 90 again energizes the solenoid 111 of the second restricting means 109 in order to unlock the master making unit 20, as stated earlier. In this condition, the operator pulls out the master making unit 20, finds the stencil jam occurred in the unit 20 from above the unit 20, and cuts off and removes the jamming portion of the perforated stencil 22. Thereafter, the stencil 22 is again set and then conveyed until its leading edge reaches the previously mentioned waiting position. Then, the controller 90 determines whether or not the second sensor 37 and first sensor 36 have turned off.

If the two sensors 37 and 36 have turned off, the controller 90 determines that the stencil 22 has been adequately set at the waiting position, turns off the lamp 99B, and causes the information on the guidance area 98A and auxiliary portion 98B to disappear. None of the descriptions relating to the turn-off of the lamp 99B and information on the guidance area 98A and auxiliary area 98B will be made in relation to the operation program to follow in order to avoid redundancy. If the stencil 22 is not adequately set, e.g., if the leading edge of the stencil 22 is not sensed, the controller 90 causes the LCD 98 to display corresponding information on the guidance area 98A and auxiliary area 98B. At the same time, the controller 90 alerts the operator to the above occurrence via the buzzer or similar alerting means.

When the operator pushes the master making unit 20 into the printer body, the unit sensor 39 senses it. In response to the resulting output of the unit sensor 39, the controller 90 again operates the second restricting means 109 so as to bring the stop 110 to its locking position. As a result, the master making unit 20 is locked in the printer body and waits for the master making step to follow.

After the above jam processing, the operator again presses the start key 96. In response, the master making operation is repeated in parallel with the scanning of the document 74. The master making operation is continued if the second sensor 37 and first sensor 36 each determines that the perforated stencil 22 has moved away from its location within the preselected period of time.

The master making step is followed by the master feeding step, as follows. The leading edge of the perforated stencil 22 is guided and steered by the guide plates 35 to between the stage 4*b* and the damper 4 opened away from the stage 4*b*. Assume that the leading edge of the stencil or master 22 has reached the damper 4, as determined in terms of the number of steps of the stepping motor 27M. Then, the opening/closing means closes the damper 4 from the phantom line position to the solid line position. As a result, the damper 4 clamps the leading edge of the master 22 in cooperation with the stage 4*b*. The drum 2 is again rotated clockwise, as viewed in FIG. 4, at substantially the same speed as the speed at which the stencil 22 is conveyed in the master making and feeding section 19, wrapping the master 22 therearound.

Assume that the master sensor 14 does not sense the master 22 between the stage 4*b* and the damper 4 after the closing of the damper 4 or during the above stencil wrapping procedure. Then, the master sensor 14 sends its output (ON signal) representative of the absence of the master 22, i.e., a defective transport signal relating to master feed to the controller 90. In response, the controller 90 determines that the damper 4 has failed to clamp the master 22, and then executes the following control based on a master feed jam routine. The controller 90 controls the main motor and a braking device, not shown, in order to stop the drum 2 at a preselected home position. Also, the controller 90 controls the stepping motor 27M in order to stop the rotation of the platen roller 27 and conveyor rollers 25. As a result, the operation for making a master and feeding it is interrupted. At the same time, the controller 90 turns on the lamp 99B in order to inform the operator of the master feed jam while displaying a master feed jam message and the location of the jam on the guidance area 98A and auxiliary area 98B, respectively.

The controller 90 controls the tray motor 46 in order to hold the sheet tray 41 in the restricting position, and controls the solenoid 111 in order to hold the stop 110 in its locking position in the previously stated manner. Subsequently, the controller 90 controls the cutter motor 24M such that the cutter 24 cuts the trailing edge of the master 22. As a result, the trailing edge of the jamming master 22 is cut off from the stencil. Thereafter, the controller 90 controls the stepping motor 27M in order to cause the conveyor rollers 25 to drive the master 22 cut off to the outside of the master making unit 20. At this instant, the controller 90 operates the first electromagnetic clutch 27C so as to rotate only the conveyor rollers 25 while maintaining the platen roller 27 in a halt.

As stated above, the removal of the cut piece of the stencil or master 22 is effected after the operator has fully pulled out the drum unit 13 from the printer body. Subsequently, the operator pushes the drum unit 13 into the printer body. It is to be noted that when the drum unit 13 is pulled out of the printer body, the controller 90 renders all the drive systems inoperative in response to the OFF state of the previously mentioned power source signal of the drum unit 13. When the drum unit 13 is again pushed into the printer body, the controller 90 detects the connection of the drum unit 13.

The controller 90 determines, based on the output of the tray sensor 48, whether or not the sheet tray 41 is higher than the unrestricting position. If the tray 41 is higher than the unrestricting position, the controller 90 lowers it to the unrestricting position via the tray motor 46.

Subsequently, the controller 90 energizes the solenoid 111 to move the stop 110 of the second restricting means 109 to its unlocking position. Then, the operator can pull out the master making unit 20 from the printer body, remove the remaining master 22, if any, from above the master making unit 20, and again set the stencil 22. Thereafter, the controller 90 determines whether or not the second sensor 37 and first sensor 36 have turned off. If the answer of this decision is positive, the controller 90 determines that the stencil 22 is adequately set at the waiting position stated earlier. After the operator has pushed the master making unit 20 into the printer body, the controller 90 again causes the second restricting means 109 to lock the unit 20 in response to the output of the unit sensor 39.

On the other hand, when the master sensor 14 determines that the master 22 has been successfully clamped, the master 22 is continuously wrapped around the drum 2 being rotated. When the controller 90 determines that a single master 22 is fully perforated in terms of the number of steps of the stepping motor 27M, it causes the platen roller 27 and conveyor rollers 25 to stop rotating and interrupts the rotation of the drum 2. Just after this, the controller 90 causes the cutter 24 to move in the widthwise direction of the stencil 22 while being rotated by the cutter motor 24M, thereby cutting off the trailing edge of the master 22 from the stencil.

Assume that the second sensor 37 and/or the first sensor 36 turns on when the drum 2 reaches the preselected angular position, i.e., completes one rotation in this embodiment. This means that the master 22 cut off or the remaining perforated part of the stencil 22 is present at a position downstream of the waiting position relating to master making. Then, the sensor 37 and/or the sensor 36 sends a defective transport signal (ON signal) relating to a master feed jam to the controller 90. In response, the controller 90 determines that a master feed jam has occurred, e.g., that the damper 4 has failed to clamp the master 22 or that the remaining perforated part of the stencil 22 is left protruding from the master making unit 20. Then, the controller 90 again executes the control based on the master feed jam processing program.

When the master feed jam is adequately dealt with or when the master making step is adequately completed, the second sensor 37 and first sensor 36 both turn off, showing that the master 22 is absent on the path downstream of the above waiting position. At this time, the controller 90 determines that the master feed jam has been adequately dealt with or that the master making step has been completed. Subsequently, the controller 90 causes the drum 2 to rotate clockwise, as viewed in FIG. 4, so as to wrap the entire master 22 therearound. This is the end of the master feeding step.

The master feeding step is followed by the sheet feeding step, printing step, and sheet discharging step. First, one sheet S is fed from the sheet tray 41 by the pick-up roller 42, separator roller 43, and reverse roller 43*a*. The registration roller pair 44 drives the sheet S toward the drum 2 and press roller 9 at a preselected timing synchronous with the rotation of the drum 2. When a sheet sensor, not shown, senses the sheet S, the press roller 9 is released from the previously mentioned retaining means and pressed against the drum 2 with the intermediary of the sheet S. At this instant, the ink fed to the inner periphery of the drum 2 by the ink roller 6 oozes out via the perforations of the master 22. The ink is transferred from the drum 2 to the sheet S via the master 22, printing an image on the sheet S. The sheet S with the image, i.e., a printing is peeled off from the drum 2 by the peeler 62 which adjoins the drum 2 then. The sheet S separated from the drum 2 is conveyed by the belt 65 due to the rotation of the outlet roller 64 while being retained on the belt 65 by the suction fan 66. Finally, the sheet S is driven out onto the tray 61 as a trial printing. The perforations of the master 22 are filled with the ink at the same time as the trial printing is produced.

Next, the operator inputs a desired number of printings on the numeral keys 97 of the operation panel 95 and again presses the start key 96. In response to the resulting print start signal from the start key 96, the controller 90 repeats the sheet feeding step, printing step and sheet discharging step in the same manner as during trial printing a number of times corresponding to the desired number of printings. This is the end of the entire printing procedure.

In the above embodiment, the stencil 22 is determined to be in its waiting position relating to master making when its leading edge is positioned on the lower or stationary edge of the cutter 24. Alternatively, the waiting position may be such that the leading edge of the stencil 22 is nipped by the conveyor rollers 25. In such a case, when the stencil 22 is set for the first time, its leading edge is sensed by the leading edge sensor positioned above the stationary edge and then sensed by the second sensor 37 and first sensor 36 within the preselected period of time for transport. Subsequently, when the leading edge of the stencil 22 is nipped by the conveyor rollers 25, as determined in terms of the number of steps of the stepping motor 27M, it is determined to be in its waiting position. When the sensors 37 and 36 do not sense the leading edge of the stencil 22 within the above period of time, the controller 90 executes the transport jam processing.

In the above alternative waiting position, the sensors 37 and 36 both turn on (ON signals), and the perforation of the stencil 22 begins at this position. After a single master 22 has been formed in the stencil by the previously stated procedure, the trailing edge of the master 22 is cut by the cutter 24. When the trailing edge of the master 22 being wrapped around the drum 2 moves away from the sensors 37 and 36, the sensors 37 and 36 send OFF signals to the controller 90. If the controller 90 receive the OFF signals within the preselected period of time, it determines that the master 22 has been accurately fed without any transport jam or master feed jam. In the case of a transport jam or a master feed jam, the controller 90 again executes the jam processing.

In the illustrative embodiment, the controller 90 determines whether or not the conveyance is adequate on the basis of the time counted by its timer, as stated earlier. Of course, the controller 90 may make such a decision by comparing the actual number of steps of the stepping motor 27M with a preselected number of steps.

While the document reading section 70 is shown as affixed to the printer body, it may be implemented as a slidable or openable unit, depending on the application. In the embodiment, the master making unit 20 is moved into and out of the printer body by being guided by the relatively long outer rails 33 and inner rails 34. Alternatively, the outer rails 33 and inner rails 34 each may be divided into short fragments and arranged at the top, bottom right and left so as to allow the master making unit 20 to be simply mounted and dismounted from the printer body.

The embodiment shown and described has various unprecedented advantages, as enumerated below.

(1) While the document reading section 70 is affixed to the printer body, the master making unit 20 is movable into and out of the printer body. This allows the operator to pull out the master making unit 20 and then set or replace the stencil 22 or deal with a jam easily via a space available above or even below the unit 20 and broader than the space available with the conventional printer. This advantage is achievable without resorting to an increase in the mechanical strength, weight or the number of parts of the portion for mounting the document reading section 70.

(2) When a trouble occurs in a section other than the document reading section, sheet discharging section and sheet feeding section during master making and feeding operation, and when a jam occurs in the master making and feeding section, it has been customary to deal with the jam only from above the master making and feeding section, resulting in troublesome work. In the illustrative embodiment, the master making unit 20 can be pulled out of the printer body and allows the jam to be dealt with from above the master making and feeding section, thereby obviating the conventional troublesome work.

(3) When the stencil 22 is set or replaced, the controller 90 controls, in response to the stencil absent signal output from the third sensor 38, the solenoid 111 of the second restricting means 109 in order to maintain the stop 110 in its locking position until the controller 90 brings the sheet tray 41 to the unrestricting position via the tray motor 46 of the first restricting means 49. This prevents the master making unit 20 from being accidentally pulled out of the printer body and caused to contact or hit against the side fences 47 of the tray 41. After the tray 41 has reached the unrestricting position, the controller 90 moves the stop 110 to the unlocking position via the solenoid 111. The master making unit 20 can therefore be pulled out without being obstructed by the side fences 47. In addition, design freedom is enhanced because the embodiment is practicable with the existing sheet tray configuration, i.e., only if the control arrangement is changed.

(4) When the stencil 22 being conveyed in the master making unit 20 jams the path, the second sensor 37 and/or the first sensor 36 sends a defective transport signal to the controller 90, indicating that the stencil 22 has not moved away from the sensor within a preselected period of time. In response, the controller 90 holds the stop 110 in its locking position via the solenoid 111 until the sheet tray 41 has been brought to its unrestricting position by the tray motor 46, determining that a transport jam has occurred. This is also successful to achieve the advantages stated in the above item (3).

(5) Assume that a master feed jam occurs, i.e., that the clamper 4 fails to clamp the perforated stencil 22 or that the perforated stencil 22 is left protruding from the master making unit 20. Then, in response to a defective transport signal or master absent signal output from the master sensor 14 when or after the perforated stencil 22 has been clamped by the damper 4 or in response to a defective transport signal or master present signal output from the second sensor 37 and/or the first sensor 36 on one full rotation of the drum 2, the controller 90 determines that a master feed jam has occurred. Then, the controller 90 holds the stop 110 in its locking position until the sheet tray 41 has been brought to the unrestricting position, as stated above, and subsequently causes the cutter 24 to cut the trailing edge of the master 22 via the cutter motor 24M. Thereafter, the controller 90 controls the stepping motor 27M and first electromagnetic clutch 27C in order to forcibly discharge the cut master from the master making unit 20. If the master 22 caused a master feed jam or not clamped by the damper 4 can be removed only from the drum 2 side, the ink deposited on the master 22 will be transferred to the conveying portions and drive portions of the master making unit 20 and constitute resistance.

When the sheet tray 41 is loaded with a great number of sheets S, and when the tray 41 does not interfere with the master making unit 20 when the unit 20 is pulled out, the stop 110 locks the master making unit 20, allowing the expected purpose to be achieved more positively for the following reason. The tray sensor 48 is expected to output an ON signal without fail when the tray 41 is raised until the top sheet S contacts the pick-up roller 42, and then lowered by a preselected distance. Therefore, if the sensor 48 does not output an ON signal at the above instance when, e.g., the position of the tray 41 should be confirmed, it is only necessary to determine that the tray 41 is in its unrestricting position where its side fences 47 do not conflict with the master making unit 20, and that the tray 41 is loaded with a great number of sheets S.

The above embodiment is, of course, applicable even to a stencil printer of the type having a slidable or openable document reading unit. With the embodiment, it will be possible to set documents, set or replace a stencil and deal with stencil jams without moving the document reading unit or dislocating the documents.

While the illustrative embodiment includes two restricting means, i.e., the first and second restricting means 49 and 109, only one of them suffices. Specifically, the control system shown and described may be replaced with a control system including only one of the two restricting means 49 and 109 and the controller 90 having any one of the following four different additional functions. The alternative control system also achieves the previously stated advantages.

First, the controller 90 control, in response to the stencil absent signal output from the third sensor 38, the tray motor 46 in order to lower the sheet tray 41 to the unrestricting position. This successfully prevents the side fences 47 of the tray 41 from interfering with the master making unit 20 when the unit 20 is pulled out, so that the operator can pull out the unit 20 and set or replace the stencil 22 immediately. With this function, it is possible to enhance design freedom while maintaining the existing configuration of a sheet tray.

Second, the controller 90 controls, in response to the defective transport signal output from the second sensor 37 and/or the defective transport signal output from the first sensor 36, the tray motor 46 to lower the sheet tray 41 to the unrestricting position. This also successfully prevents the side fences 47 of the tray 41 from interfering with the master making unit 20 when the unit 20 is pulled out, so that the operator can pull out the unit 20 and set or replace the stencil 22 immediately. In addition, design freedom is enhanced because the embodiment is practicable with the existing sheet tray configuration, i.e., only if the control arrangement is changed.

Third, the controller 90 controls, in response to the defective transport signal output from the second sensor 37 and/or the defective transport signal output from the first sensor 36, the tray motor 46 in order to restrict the movement of the master making unit 20 out of the printer body. Stated another way, in response to the above signal, the controller 90 controls the motor 46 such that the sheet tray 41 rises to and remains at the restricting position and prevents the master making unit 20 from being pulled out of the printer body. If the master 22 caused a master feed jam or not clamped by the damper 4 can be removed only from the drum 2 side, the ink deposited on the master 22 will be transferred to the conveying portions and drive portions of the master making unit 20 and constitute resistance.

Fourth, the controller 90 controls, in response to the defective transport signal output from the second sensor 37 and/or the defective transport signal output from the first sensor 36 or from the master sensor 14, the solenoid 111 in order to prevent the master making unit 20 from being pulled out of the printer body. Stated another way, in response to the above signal, the controller 90 deenergizes the solenoid 111 to prevent the master making unit 20 from being pulled out of the printer body. This is also successful to achieve the above advantage.

Another specific control system available with this embodiment is as follows. In response to the defective transport signal or master absent signal output from the master sensor 14 when or after the damper 4 has clamped the master 22, or in response to the defective transport signal or master present signal output from at least one of the second sensor 37 and first sensor 36 when the drum 2 completes one full rotation, the controller 90 determines that a master feed jam has occurred. Then, the controller 90 raises the sheet tray 41 to the restricting position via the tray motor 46 and moves the stop 110 to its locking position via the solenoid 111. Subsequently, in response to the output of the drum sensor showing that the drum unit 13 has been pulled out of the printer body, the controller 90 causes the cutter 24 to cut the trailing edge of the master 22 via the cutter motor 24M. Thereafter, the controller 90 controls the stepping motor 27M and first electromagnetic clutch 27C such that the conveyor rollers 25 drive the master 22 cut off to the outside of the master making unit 20.

With the above control system, the following advantages are achievable in addition to the advantages of the first embodiment. In the event of a master feed jam, e.g., when the damper 4 fails to clamp the perforated stencil 22 or when the leading edge of the perforated stencil 22 is left protruding from the master making unit 20, the controller 90 allows the trailing edge of the master 22 to be cut and allows the cut master 22 to be driven out of the unit 20 only when the drum unit 13 is pulled out to the inoperative position where the drum sensor turns on. In this condition, the drum unit 13 is held by the printer body without any clearance, preventing the operator's hand or the like from being inserted by accident. This is desirable from the safety standpoint. Thereafter, the drum unit 13 is fully pulled out of the printer body in order to cut off and remove the master 22. Because the cut piece of the stencil 22, for example, is prevented from adhering to the circumference of the drum 2, the removal of the cut master 22 not clamped by the damper 4 or jamming the path is further facilitated.

Figure 12:
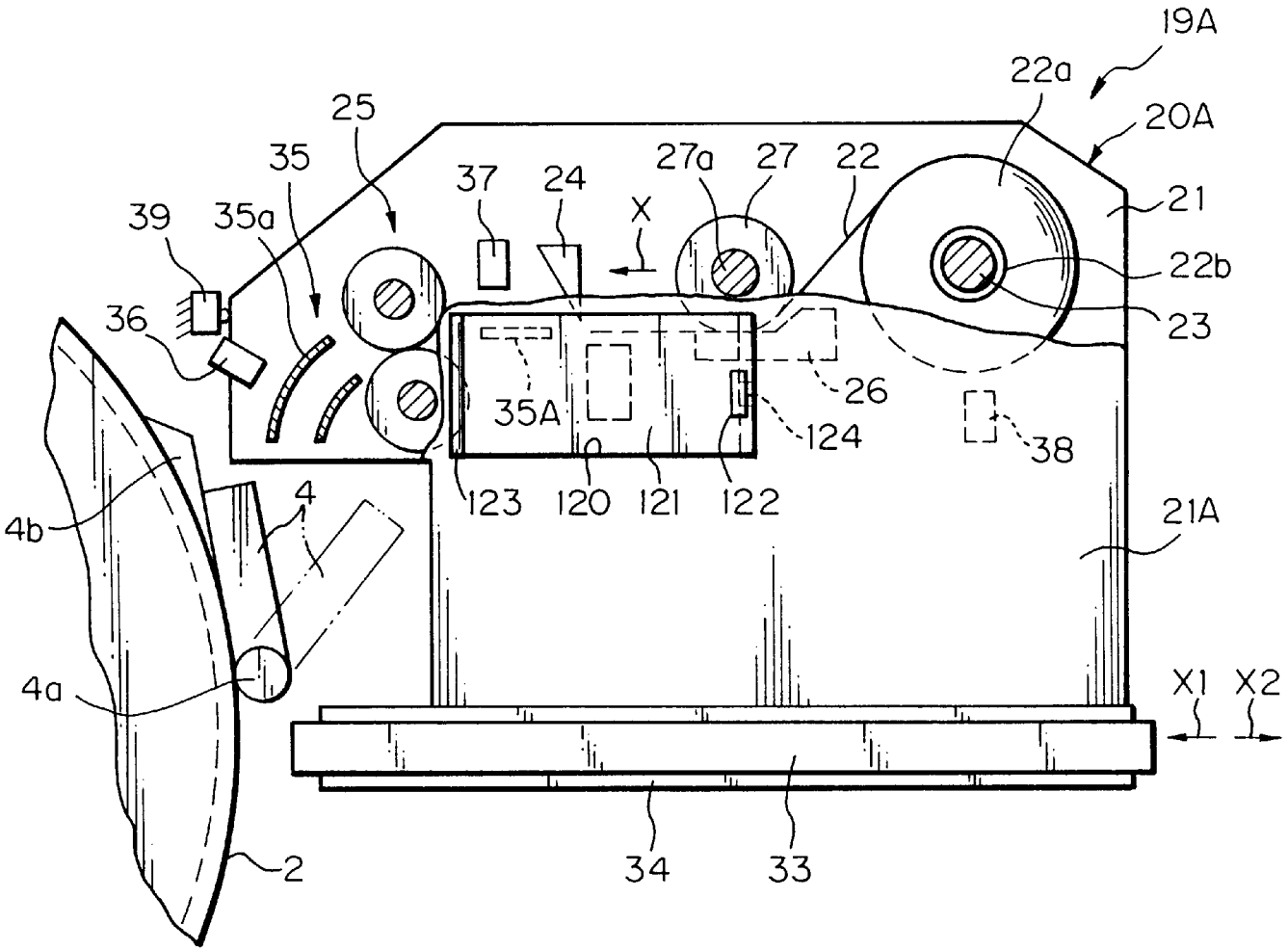
FIG. 12 is a fragmentary partly sectional front view showing a modification of the first embodiment.

FIG. 12 shows a modification of the first embodiment. As shown, the modification includes a master making and feeding section 19A having a master making unit 20A. The master making unit 20A differs from the master making unit 20 in that it allows the master 22 existing therein to be removed sideways perpendicularly to the front-and-rear direction X1-X2, i.e., in the widthwise direction of the stencil 22.

Specifically, as shown in FIG. 12, a front side wall 21A included in the master making unit 20A is formed with an opening 120 for allowing the master 22 to be picked out from the unit 20A sideways. The opening 120 extends along the stencil transport path between a position below the platen roller 27 and a position downstream of the conveyor rollers 25 in the subscanning direction X. A door 121 is openably mounted on the side wall 21A in order to close the opening 120. The front end of the door 121 is implemented as a hinge portion 123 for openably supporting the door 121. The hinge portion 123 is supported by the front upper and lower edges of the opening 120 via a hinge pin, not shown. A knob 122 is provided on the rear end of the door 121, so that the operator intending to open or close the door 121 can hold it. So-called magnet catches 124 are respectively arranged on the portion of the side wall 21A adjacent to the rear edge of the opening 120 and the back of the rear end of the door 121, as indicated by phantom lines in FIG. 12. The magnet catches 124 cooperate to retain the door 121 in its closed position.

The above modification is advantageous in that, e.g., the master 22 present in the master making unit 20A and jamming the path can be dealt with not only from above the unit 20A but also from the side of the unit 20A by opening the door 121, as desired. This facilitates jam processing free from troublesome work.

While the door 121 is used to block dust and other impurities as far as possible and to insure safety operation, it is omissible, if desired. The magnetic catches 124 may be replaced with, e.g., a concave clip and a convex clip so long as they are capable of maintaining the door 121 in its closed position.

2nd Embodiment

Figure 13:
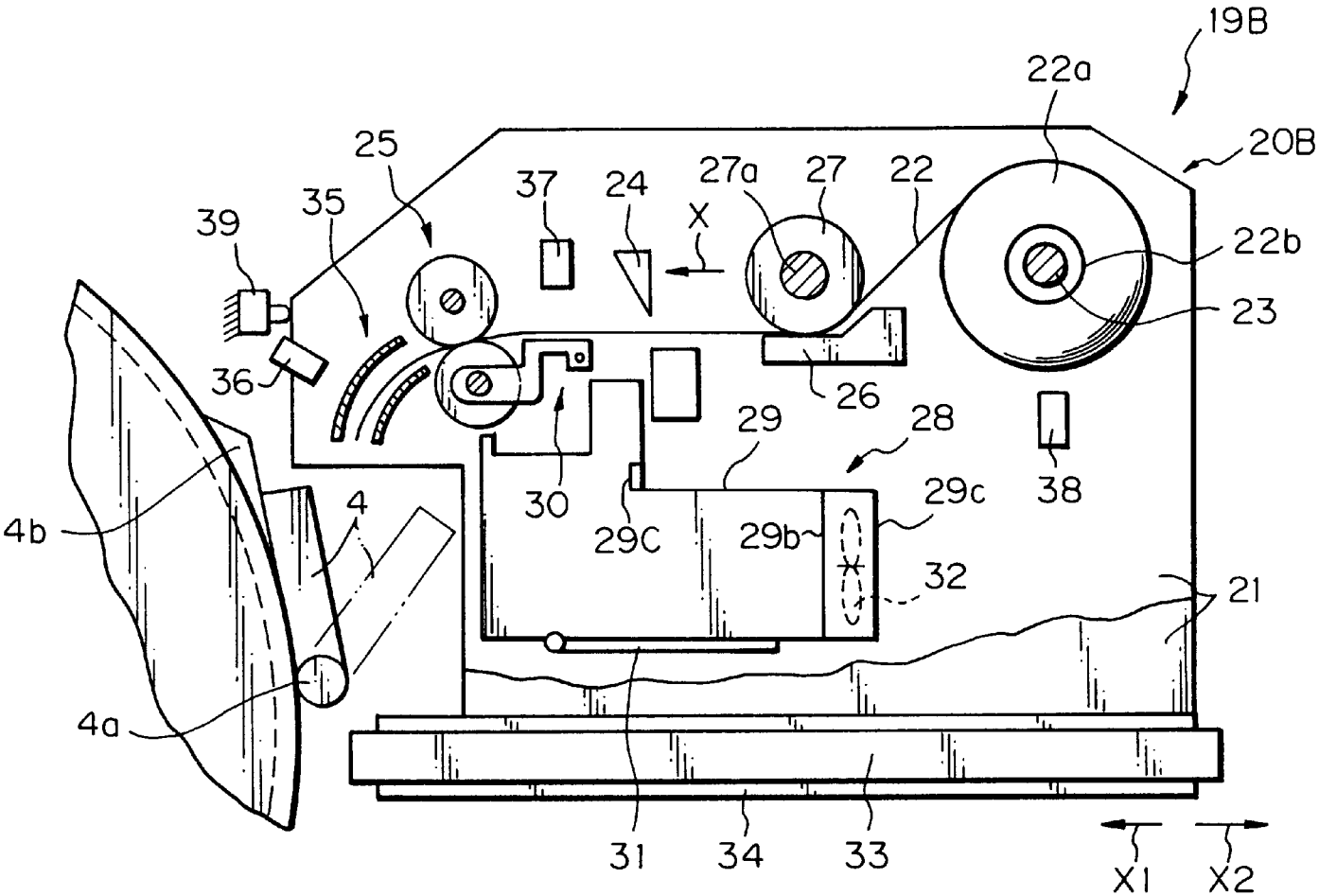
FIG. 13 is a partly section front view showing an essential part of a second embodiment of the present invention.

Referring to FIGS. 13–17, a second embodiment of the present invention will be described. As shown in FIG. 13, the second embodiment includes a master making and feeding section 19B having a master making unit 20B. The master making unit 20B differs from the master making unit 20 of the first embodiment in that it additionally includes master stocking means 28 and a control arrangement for controlling the master stocking means 28. The master stocking means 28 temporarily stocks the part of the stencil 22 perforated by the master making means.

The master stocking means 28 includes a box 29, a guide plate 30, a guide plate drive mechanism 130 (FIG. 15), a suction fan 32, and a fan motor 32M (shown only in FIG. 11). The master stocking means 28 causes the perforated stencil or master 22 to form a slack and sequentially receives the slack for a moment.

Figure 14:
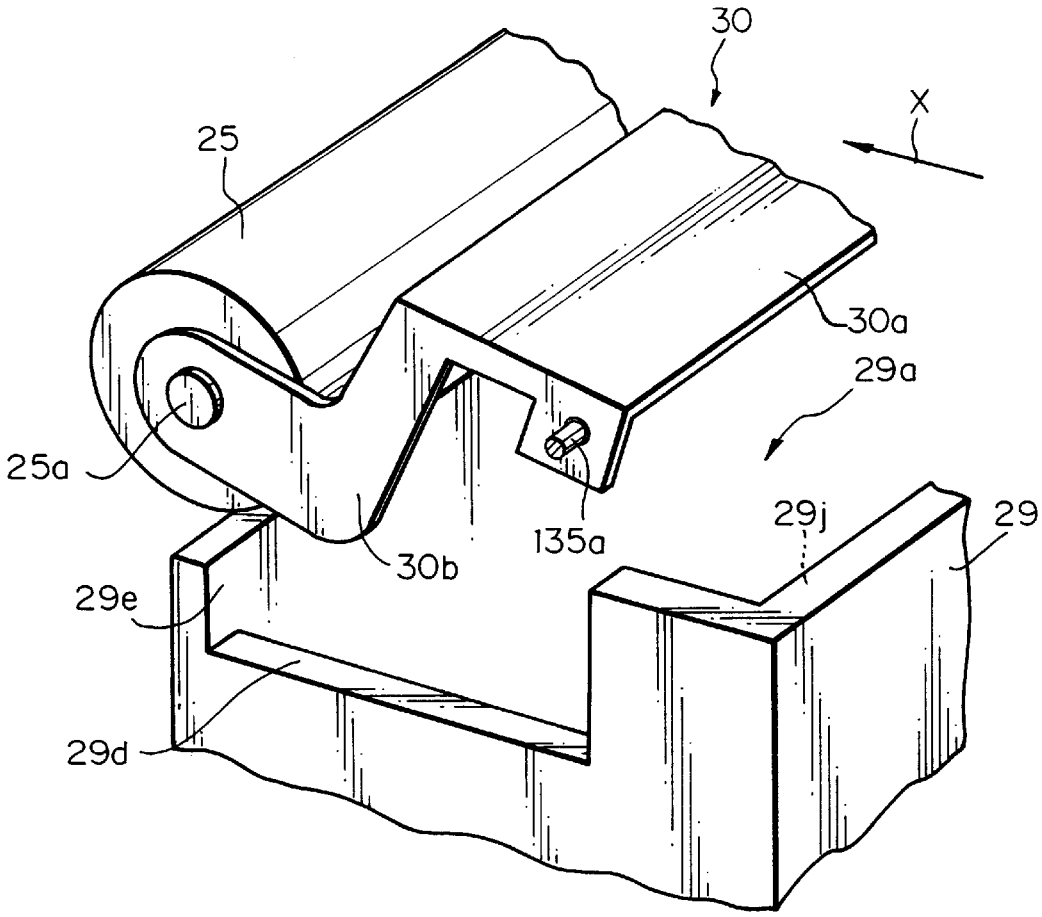
FIG. 14 is a fragmentary perspective view showing a guide plate included in the second embodiment.
Figure 16:
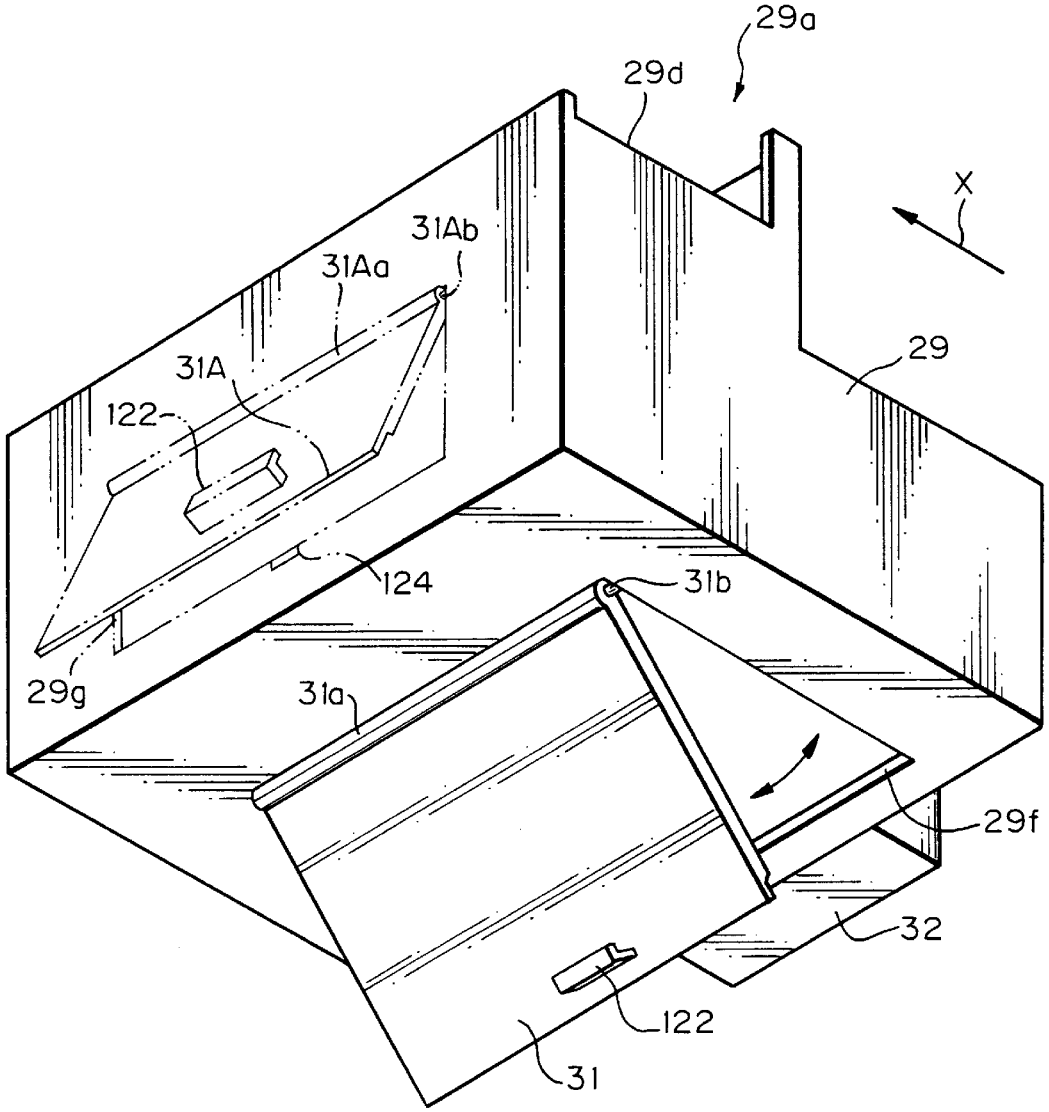
FIG. 16 is a fragmentary perspective view showing a box also included in the second embodiment.
Figure 17:
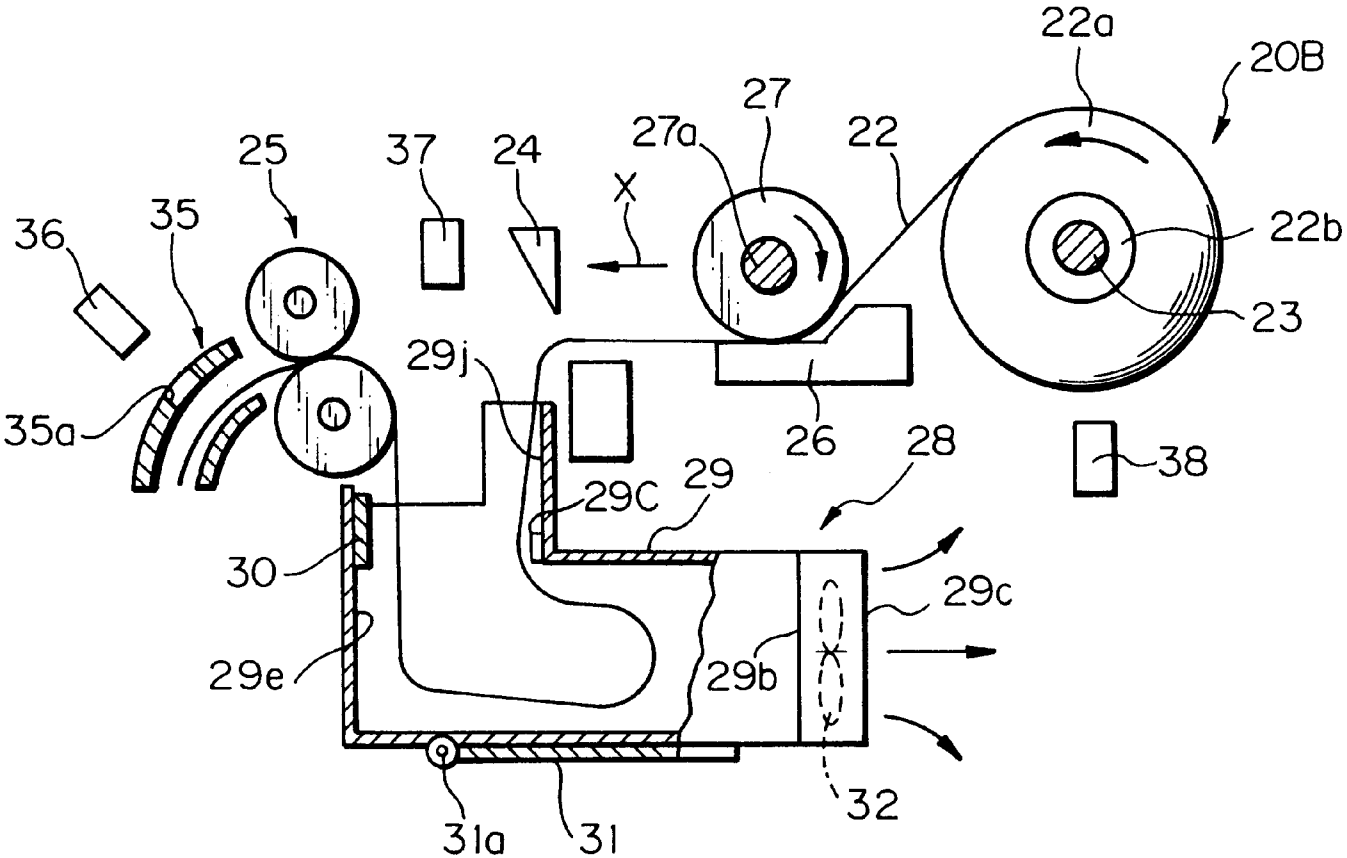
FIG. 17 is a partly sectional front view demonstrating the operation of master stocking means also included in the second embodiment.

The box 29 is generally L-shaped, as seen in a front view, and implemented by a molding of synthetic resin by way of example. As shown in FIGS. 14 and 16, an opening 29*a* for introducing the master 22 into the box 29 is formed in the top of the box 29. Opposite side walls of the box 29 each is formed with a notch 29*d* contiguous with the opening 29*a*. When the guide plate 30 is moved downward or closed, as will be described later, the notches 29*d* of the box 29 respectively allow a pair of arms 30*b* included in the guide plate 30 to pass therethrough. The box 29 has a front wall whose inner surface 29*e* plays the role of a stop for stopping the guide plate 30 being lowered at a slack forming position, as will be described specifically later. The box 29 has at its upstream end in the subscanning direction X a suction hole 29*b* and an exhaust hole 29*c* each being implemented as a slit or a mesh-like apertures by way of example. The suction fan 32 intervenes between the suction hole 29*b* and the exhaust hole 29*c* and driven by the fan motor 32M. When the suction fan 32 is driven by the fan motor 32M, it generates a stream of air flowing from the left to the right, as viewed in the drawings, and thereby allows the master 22 to sequentially slacken without sticking.

As best shown in FIG. 16, an opening 29F is formed in the bottom of the box 29 in order to allow the master 22 to be picked out downward from the box 29. A door 31 closes the opening 29*f*, but is openable in a direction indicated by an arrow in FIG. 16. The front end of the door 31 is implemented as a hinge portion 31*a* for openably supporting the door 31. The hinge portion 31*a* is openably supported by the left and right edges of the opening 29*f* by a hinge pin 31*b*. A knob 122 accessible for opening or closing the door 31 is provided on the rear end of the door 31. Magnet catches, not shown, are respectively affixed to the bottom of the box 29 adjacent to the rear edge of the opening 29F and the back of the rear end of the door 31, so that the door 31 can be held in its closed position.

A slack sensor 29C is mounted on the inner surface 29*j* of the rear wall of the box 29 and implemented by a reflection type optical sensor. The slack sensor 29C determines whether or not the master 22 is present in the box 29, i.e., whether or not the master 22 has been successfully conveyed into the box 29 without a jam.

The guide plate 30 is implemented by, e.g., a sheet metal or a stainless steel sheet subjected to surface treatment or by synthetic resin. A master guide surface 30*a* is molded integrally with the guide plate 30. The guide plate 30 is angularly movable between a guide position shown in FIG. 13 and a slack position shown in FIG. 17. In the guide position, the master guide surface 30*a* is positioned parallel to the subscanning direction X beneath the stencil transport path, guiding the stencil 22 therealong. When the guide plate 30 is lowered to the slack position due to its own weight, the master guide surface 30*a* is positioned perpendicularly below the lower conveyor roller 25, as partly shown in FIG. 17. In the slack position, the guide plate 30 uncovers the top of the box 29 where the opening 29*a* is present.

The right and left end of the guide plate 30 are bent perpendicularly to the master guide surface 30*a*, forming the arms 30*b* which are generally crank-shaped, as seen in a front view. One end of each arm 30*b* is rotatably supported by a shaft 25*a* on which the lower conveyor roller 25 is mounted.

Figure 15:
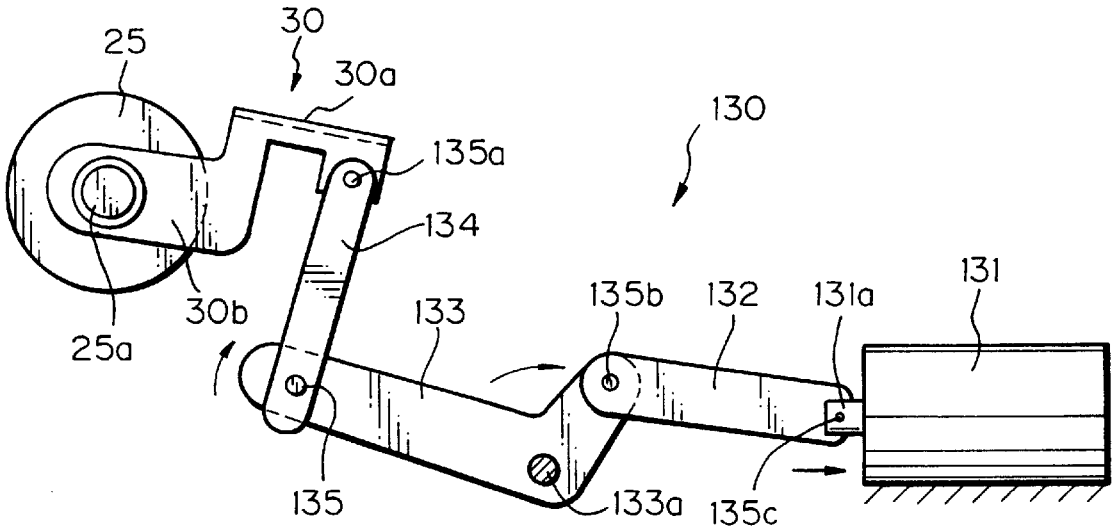
FIG. 15 is a sectional front view showing an essential part of a guide plate drive mechanism also included in the second embodiment.

The guide plate drive mechanism 130 causes the guide plate 30 to move upward to its guide position, as needed. As shown in FIG. 15, the mechanism 130 includes a link 134 connected to the free end of the arm 30*b* by a pin 135*a*. A link or intermediate link 133 is connected at one end to the other end of the link 134. A link or drive link 132 is connected at one end to the other end of the intermediate link 133 by a pin 135*b*. A plunger 131*a* extends out from a solenoid 131 and has its end connected to the other end of the drive link 132 by a pin 135*c*.

The pin 135*a* is loosely fitted in the free end of the front (or left) arm 30*b*, as viewed in FIG. 15. The pin 135*a* extends to the outside of the front side wall 21 via a notch formed in the front side wall 21 and is connected to one end of the link 134. The intermediate link 133 is generally L-shaped and rotatably supported by the outer surface of the front side wall 21 via a pin 133*a* at the bend of the letter L. The solenoid 131 is mounted on the outer surface of the front side wall 21. When the solenoid 131 is energized (ON), it pulls the plunger 131*a* in a direction indicated by an arrow in FIG. 15 (to the right), causing the consecutive links to sequentially rotate as indicated by arrows. As a result, the guide plate 30 is raised from the slack position to the guide position, as shown in FIG. 14 also. When the solenoid 131 is deenergized (OFF), the links sequentially rotate in directions opposite to the above directions due to the weight of the guide plate 30. Consequently, the guide plate 30 is lowered to the slack position and stopped by the inner surface 29*e* of the box 29.

In this embodiment, the upper or drive conveyor roller 25 is connected to the stepping motor 27M via a second electromagnetic clutch 25C (shown only in FIG. 11) and the drive transmitting means stated earlier. When the clutch 25C is operated, the rotation of the stepping motor 27M is transmitted to the platen roller 27, but not transmitted to the drive conveyor roller 25.

Reference will again be made to FIG. 11 for describing a control arrangement unique to this embodiment. In FIG. 11, boxes indicated by phantom lines are additionally included in the second embodiment. As shown, the controller 90 interchanges command signals, ON/OFF signals and data signals with the slack sensor 29C, second electromagnetic clutch 25C, solenoid 131 and fan motor 32M via drivers, suitable electronic circuitry and I/O and I/F 94.

The operation of the second embodiment, particularly a master making step and a master feeding step unique thereto, will be described hereinafter. In this embodiment, the position where the stencil 22 waits for the master making step is such that its leading edge is nipped by the conveyor rollers 25, as shown in FIG. 13. In this case, when the solenoid 131 is energized, the guide plate 30 rises from the slack position to the guide position and guides the leading edge of the stencil 22 to the waiting position of FIG. 13 without causing it to drop into the box 29.

During master making operation effected in parallel with document reading operation, the solenoid 131 is deenergized so as to lower the guide plate 30 to the slack position. The operation of the master stocking means 28 will be only briefly described hereinafter.

The thermal head 26 is operated in accordance with the digital image signal subjected to various kinds of processing in the ADC and master making controller, as in the first embodiment. At the same time, the stepping motor 27M is driven to rotate the platen roller 27 clockwise, as viewed in FIG. 13. As a result, the stencil 22 paid out from the roll 22*a* is sequentially perforated while being conveyed to the downstream side in the subscanning direction X. Further, the suction motor 32M is driven to rotate the suction fan 32 so as to generate a stream of air flowing rightward along the contour of the box 29, as viewed in FIG. 13. As a result, the perforated stencil or master 22 is sequentially introduced into the box 29 while slackening in such a manner as to droop via the opening 29*a*. The master 22 is therefore sequentially received in the box 29.

In the above condition, the first and second electromagnetic clutches 27C and 25C are operated such that the rotation of the stepping motor 27M is transmitted to the platen roller 27, but not transmitted to the conveyor rollers 25.

When the stepping motor 27M begins to be driven for the above master making procedure, the timer built in the controller 90 begins counting the duration of conveyance of the master 22 while comparing it with a preselected period of time stored in the ROM 92. Assume that the slack sensor 29C does not sense, within the preselected period of time, the master 22 expected to be forming a slack then. Then, the controller 90 determines that the master 22 has jammed the box 29, turns on the lamp 99B, and causes the LCD 98 to display a corresponding jam message and the location of the jam on the guidance area 98A and auxiliary area 98B, respectively. At the same time, the controller 90 stops driving the stepping motor 27M, i.e., the platen roller 27 and thereby interrupts the master making operation.

Subsequently, the controller 90 determines, based on the output of the tray sensor 48, whether or not the sheet tray 41 is higher than the unrestricting position, as in the first embodiment. Then, the controller 90 lowers the tray 14 to the unrestricting position via the tray motor 46.

After the sheet tray 41 has reached the unrestricting position, the controller 90 energizes the solenoid 111 so as to unlock the master making unit 20B. In this condition, the operator pulls out the master making unit 20B out of the printer body in the direction X2, opens the door 31 mounted on the bottom of the unit 20B by holding the knob 122, and then removes the jamming master 22 via the opening 29*f*. Then, the operator again sets the stencil 22, closes the door 31, and pushes the master making unit 20B into the printer body in the direction X1. As soon as the unit sensor 39 senses the master making unit 20B, the controller 90 locks the unit 20B in the printer body and waits for the master making step, as stated previously.

When the operator again presses the start key 96 after the above operation, the master making operation is repeated in parallel with the document reading operation. When the controller 90 determines that a single master 22 has been completed in terms of the number of steps of the stepping motor 27M, it switches the first and second electromagnetic clutches 27C and 25C. As a result, the rotation of the stepping motor 27M is transmitted to the conveyor roller pair 25 via the previously stated drive transmitting means, but not transmitted to the platen roller 27. At this time, the conveyor rollers 25 sequentially pull the master 22 out of the box 29 while conveying the leading edge of the master 22 toward the damper 4 held in its open position along the guide plate 35. On determining that the leading edge of the master 22 has reached the damper 4, also in terms of the number of steps of the stepping motor 27M, the controller 90 again switches the second clutch 25C so as to stop the rotation of the conveyor rollers 25. This is followed by the same procedure as described in relation to the first embodiment.

The second embodiment achieves the following advantage in addition to the advantages of the first embodiment. Even when the master 22 jams the box 29 of the master stocking means 28, the operator should only pull out the master making unit 20B, open the door 31 on the bottom of the unit 20B, and pick out the master 22. The operator can therefore deal with this kind of jam with ease. Of course, when the guide plate 30 is held in its slack position, the operator may pick out the jamming master 22 via the opening 29*a*.

The opening 29*f* formed in the bottom of the box 29 and the door 31 closing it may be replaced with any other suitable opening and door, as follows. For example, as indicated by phantom lines in FIG. 16, the box 29 and door 31 may be replaced with an opening 29*g* and a door 31A. The opening 29*g* is formed in the front end of the box 29 and usually closed by the door 31A. Further, both the opening 29*f* and door 31 and the opening 29*g* and door 31A may be provided, if desired. There are also shown in FIG. 16 a hinge portion 31A*a* and a hinge pin 31A*b*.

Figure 18:
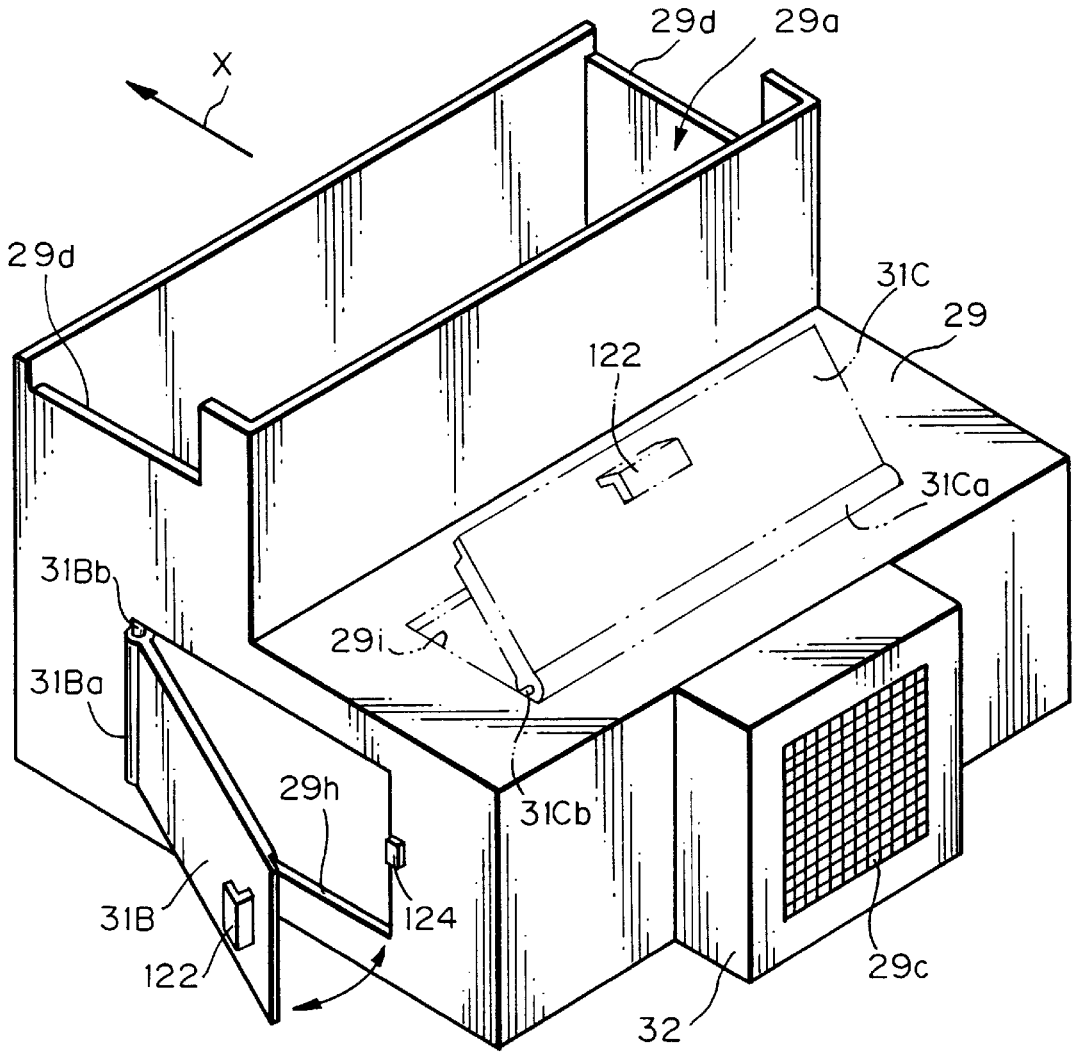
FIG. 18 is a fragmentary perspective view showing a modified form of the box included in the second embodiment.

As indicated by solid lines in FIG. 18, an opening 29*h* may be formed in the left side wall of the box 29 and closed by an openable door 31B. There are also shown in FIG. 18 a hinge portion 31B*a* and a hinge pin 31B*b*. In this case, an opening for opening and closing the door 31B should preferably be formed in the left side wall 21 facing the door 31B.

As indicated by phantom lines in FIG. 18, an opening 29*i* may be formed in the top wall of the box 29 and closed by an openable door 31C. Both the opening 29*h* and door 31B and the opening 29*i* and 31C may be provided, if desired. There are also shown in FIG. 18 a hinge portion 31C*a* and a hinge pin 31C*b*. Further, in FIG. 18, an opening and a door for closing may be positioned in the portion where the suction fan 32 is located, or in the rear wall of the box 29 adjacent to the fan 32. The crux is that the opening and door for closing be so positioned as to allow the master 22 present in the box 29 to be picked out.

Assume that the above door is formed of the same synthetic resin as the box 29, e.g., polyprolyrene (PP). Then, the hinge portion of the box 29 may be implemented as a so-called PP hinge produced by molding. This allows the door to be molded integrally with the opening portion in order to reduce the number of parts and assembling cost.

While the master stocking means 28 included in the second embodiment is relatively simple, it may be replaced with conventional master stocking means taught in, e.g., Japanese Patent Laid-Open Publication No. 61-287781 or 7-257002.

In the first and second embodiments, the platen roller 27 is driven by the stepping motor 27M. Alternatively, a stepping motor, not shown, may be used to drive the conveyor rollers 25 downstream of the platen roller 27 in the sub-scanning direction X, in which case the motor will drive the platen roller 27 via drive transmitting means, not shown. Further, an exclusive stepping motor and exclusive drive transmitting means may be assigned to each of the platen roller 27 and conveyor rollers 25, so that each roller can be controlled in a particular manner matching with an object or an application.

The thermal head 26 and platen roller 27 playing the role of master making means may be replaced with a xenon lamp or a laser, if desired.

The first and second embodiments each is practicable even with a stencil printer of the type feeding ink to a master wrapped around the drum from the outside of the drum, as taught in, e.g., Japanese Patent Laid-Open Publication No. 7-17013.

The present invention may be exclusively applied to a master making device, as distinguished from a stencil printer, including a document reading section, stencil storing means for storing a stencil while allowing it to be paid out, and master making means for perforating the stencil.

In summary, it will be seen that the present invention provides a master making device and a stencil printer including the same which have various unprecedented advantages, as enumerated below.

(1) A master making unit implemented by master making means is removably mounted to the printer body and removably supported by support means. When the master making unit is pulled out of the printer body, a broader space than conventional one is available above and/or below the unit and allows a stencil to be set or replaced or a jam to be dealt with even when a document reading section is held stationary on the printer body. In addition, this can be done without increasing the mechanical strength, weight or the number of parts of a portion where the document reading section is mounted. Even if the document reading device is movable relative to the printer body, there can be effected the setting of a document, the setting and replacement of the stencil or the jam processing without the document reading section being moved or the document being dislocated.

(2) The stencil or master existing in the master making unit can be picked out, as needed. This further facilitates jam processing, i.e., allows the operator to perform jam processing not only via the top or the bottom of the master making unit but also via any other suitable side without any troublesome work.

(3) The master present in master stocking means can be picked out. Therefore, the master jamming the master stocking means and especially difficult to remove can be removed more easily. In addition, this allows the operator to perform jam processing not only via the top or the bottom of the master making unit but also via any other suitable side without any troublesome work.

(4) When the master making unit is mounted to the printer body, sensing means surely senses the unit brought to a preselected position within the printer body. This obviates defective transport of the stencil to the outside of the master making unit due to defective mounting of the unit.

(5) Stencil storing means included in the master making unit stores the stencil such that the stencil can be paid out, as needed. The stencil can therefore be continuously perforated by being surely and stably paid out.

(6) The stencil printer with the master making device having any one of the above configurations achieves the advantages described above.

(7) When the master making unit is mounted to the printer body, sensing means surely senses the unit brought to a stencil feed position for feeding the stencil to a drum. This obviates defective transfer of the stencil to the outside of the master making unit, particularly to the drum on which ink is deposited, and the resulting deposition of ink due to defective mounting of the unit.

Various modifications will become possible for those skilled in the art after receiving the teachings of the present disclosure without departing from the scope thereof.

What is claimed is:

1. A master making device for a stencil printer, comprising:

document reading means for reading a document image;

master making means for perforating a stencil to thereby make a master, and comprising a master making unit;

support means for supporting said master making unit such that said master making unit is removable from a body of said stencil printer without said document reading means being displaced relative to said body; and master stocking means included in said master making unit for temporarily stocking the stencil perforated by said master making means wherein the stencil is removable from said master stocking means, said master stocking means comprises a box for causing the stencil perforated by said master making means to form a slackened portion and for receiving the slackened portion in said box, said box comprising an opening for allowing the stencil to be removed from said box and wherein said opening is formed in a bottom portion of said box.

2. A device as claimed in claim 1, further comprising a mechanism for removing the stencil in said master making unit.

3. A device as claimed in claim 1, wherein said box further comprises a door openably closing said opening.

4. A device as claimed in claim 3, wherein a knob is provided on said door and accessible for opening or closing said door.

5. A device as claimed in claim 1, further comprising sensing means for sensing said master making unit mounted to said body at a preselected position in said body.

6. A device as claimed in claim 1, further comprising stencil storing means included in said master making unit for storing the stencil such that the stencil is capable of being paid out.

7. A stencil printer which includes a master making apparatus for perforating a stencil to thereby make a master, a printing section having a drum for wrapping the master therearound, a sheet feeding section for feeding a sheet to said printing section, and a master discharging section for discharging a used master wrapped around said drum, wherein said master making apparatus comprises:

a document reading device for reading a document image;

a master making device for perforating a stencil to thereby make a master, and comprising a master making unit;

a support device for supporting said master making unit such that said master making unit is removable from a body of said stencil printer without said document reading device being displaced relative to said body; and a master stocking device included in said master making unit for temporarily stocking the stencil perforated by said master making device wherein the stencil is removable from said master stocking device, said master stocking device comprising a box for causing the stencil perforated by said master making device to form a slackened portion and for receiving the slackened portion in said box, and said box having an opening for allowing the stencil to be removed from said box, and wherein said opening is formed in a bottom portion of said box.

8. A stencil printer as claimed in claim 7, wherein said master making apparatus further comprises a sensing device for sensing said master making unit mounted to said body of said printer at a master feed position for feeding the master to said drum.

9. A master making apparatus for a stencil printer comprising:

a document reading device configured to read a document image;

a master making device configured to perforate a stencil to thereby make a master, and comprising a master making unit;

a support device configured to support said master making unit such that said master making unit is removable from a body of said stencil printer without said document reading device being displaced relative to said body; and a master stocking device included in said master making unit to temporarily stock the stencil perforated by said master making device wherein the stencil is removable from said master stocking device, said master stocking device comprises a box for causing the stencil perforated by said master making device to form a slackened portion and for receiving the slackened portion in said box, and said box comprises an opening configured to allow the stencil to be removed from said box, and wherein said opening is formed in a bottom portion of said box.

10. A master making apparatus as claimed in claim 9, further comprising a mechanism configured to remove the stencil in said master making unit.

11. A master making apparatus as claimed in claim 9, wherein said box further comprises a door for openably closing said opening.

12. A master making apparatus as claimed in claim 11, wherein a knob is provided on said door and accessible to open or close said door.

13. A master making apparatus as claimed in claim 9, further comprising a sensing device configured to sense said master making unit mounted to said body at a preselected position in said body.

14. A master making apparatus as claimed in claim 9, further comprising a stencil storing device included in said master making unit to store the stencil such that the stencil is capable of being paid out.

15. A master making device for a stencil printer, comprising:

document reading means for reading a document image;

master making means for perforating a stencil to thereby make a master, and comprising a master making unit; and support means for supporting said master making unit such that said master making unit is removable from a body of said stencil printer without said document reading means being displaced relative to said body wherein the stencil existing in said master making unit is removable from said master making unit, said master making unit comprising an opening for allowing the stencil to be removed from said master making unit and wherein said opening is formed in a side portion of said master making unit.

16. A device as claimed in claim 15, wherein said master making unit further comprises a door for openably closing said opening.

17. A device as claimed in claim 16, wherein a knob is provided on said door and is accessible for opening or closing said door.

18. A device as claimed in claim 15, further comprising sensing means for sensing said master making unit mounted to said body at a preselected position in said body.

19. A device as claimed in claim 15, further comprising stencil storing means included in said master making unit for storing the stencil such that the stencil is capable of being paid out.

20. A device as claimed in claim 15, further comprising master stocking means included in said master making unit for temporarily stocking the stencil perforated by said master making means wherein the stencil existing in said master stocking means is removable from said master stocking means.

21. A device as claimed in claim 20, wherein said master stocking means comprises a box for causing the stencil perforated by said master making means to form a slackened portion, and receiving the slackened portion in said box.

22. A device as claimed in claim 21, wherein said box comprises an opening for allowing the stencil to be removed from said box.

23. A device an claimed in claim 22, wherein said opening is formed on a bottom portion of said box.

24. A device as claimed in claim 22, wherein said box further comprises a door for openably closing said opening.

25. A device as claimed in claim 24, wherein a knob is provided on said door and is accessible for opening or closing said door.

26. A device as claimed in claim 20, further comprising sensing means for sensing said master making unit mounted to said body at a preselected position in said body.

27. A device as claimed in claim 20, further comprising stencil storing means included in said master making unit for storing the stencil such that the stencil is capable of being paid out.

28. A stencil printer which includes a master making apparatus for perforating a stencil to thereby make a master, a printing section having a drum for wrapping the master therearound, a sheet feeding section for feeding a sheet to said printing section, and a master discharging section for discharging a used master wrapped around said drum, wherein said master making apparatus comprises:

a document reading device for reading a document image;

a master making device for perforating a stencil to thereby make a master, and comprising a master making unit; and a support device for supporting said master making unit such that said master making unit is removable from a body of said stencil printer without said document reading device being displaced relative to said body wherein the stencil existing in said master making unit is removable from said masher making unit, said master making unit comprising an opening for allowing the stencil to be removed from said master making unit and wherein said opening is formed in a side portion of said master making unit.

29. A stencil printer as claimed in claim 28, wherein said master making apparatus further comprises a sensing device for sensing said master making unit mounted to said body of said printer at a master feed position for feeding the master to said drum.

30. A master printer as claimed in claim 28, further comprising:

a master stocking device included in said master making unit for temporarily stocking the stencil perforated by said master making device wherein the stencil existing in said master stocking device is removable from said master stocking device.

31. A master making apparatus for a stencil printer, comprising:

a document reading device for reading a document image;

a master making device for perforating a stencil to thereby make a master, and comprising a master making unit; and a support device for supporting said master making unit such that said master making unit is removable from a body of said stencil printer without said document reading device being displaced relative to said body wherein the stencil existing in said master making unit is removable from said master making unit, said master making unit comprising an opening for allowing the stencil to be removed from said master making unit and wherein said opening is formed in a side portion of said master making unit.

32. A master making apparatus as claimed in claim 31, wherein said master making unit further comprises a door for operably closing said opening.

33. A master making apparatus as claimed in claim 32, wherein a knob is provided on said door and is accessible to open or close said door.

34. A master making apparatus as claimed in claim 31, further comprising a sensing device configured to sense said master making unit mounted to said body at a preselected position in said body.

35. A master making apparatus as claimed in claim 31, further comprising a stencil storing device included in said master making unit to store the stencil such that the stencil is capable of being paid out.

36. A master making apparatus as claimed in claim 31, further comprising a master stocking device included in said master making unit to temporarily stock the stencil perforated by said master making device wherein the stencil existing in said master stocking device is removable from said master stocking device.

37. A master making apparatus as claimed in claim 36, wherein said master stocking device comprises a box for causing the stencil perforated by said master making device to form a slackened portion, and receiving the slackened portion in said box.

38. A master making apparatus as claimed in claim 37, wherein said box comprises an opening configured to allow the stencil to be removed from said box.

39. A master making apparatus as claimed in claim 38, wherein said opening is formed on a bottom portion of said box.

40. A master making apparatus as claimed in claim 38, wherein said box further comprises a door configured to operably close said opening.

41. A master making apparatus as claimed in claim 40, wherein a knob is provided on said door and is accessible to open or close said door.

42. A master making apparatus as claimed in claim 36, further comprising a sensing device configured to sense said master making unit mounted to said body at a preselected position in said body.

43. A master making apparatus as claimed in claim 36, further comprising a stencil storing device included in said master making unit to store the stencil such that the stencil is capable of being paid out.

* * * * *

UNITED STATES PATENT AND TRADEMARK OFFICE

CERTIFICATE OF CORRECTION

PATENT NO. : 6,076,460
DATED : June 20, 2000
INVENTOR(S) : Hideyuki Kagawa

It is certified that error appears in the above-identified patent and that said Letters Patent is hereby corrected as shown below:

Column 10,
Line 27, change "damper" to -- clamper --;
Line 31, change "damper" to -- clamper --;
Line 33, change "damper" to -- clamper --;
Line 35, change "damper" to -- clamper --;
Line 39, change "damper" to -- clamper --;

Column14,
Line 7, change "damper" to -- clamper --;

Column 15,
Line 45, change "damper" to -- clamper --;
Line 48, change "damper" to -- clamper --;

Column 17,
Line 21, change "damper" to -- clamper --;
Line 23, change "damper" to -- clamper --;
Line 27, change "damper" to -- clamper --;
Line 34, change "damper" to -- clamper --;
Line 35, change "damper" to -- clamper --;
Line 40, change "damper" to -- clamper --;

Column 18,
Line 50, change "damper" to -- clamper --;

Column 20,
Line 65, change "damper" to -- clamper --;

Column 21,
Line 10, change "damper" to -- clamper --;

UNITED STATES PATENT AND TRADEMARK OFFICE

CERTIFICATE OF CORRECTION

PATENT NO. : 6,076,460
DATED : June 20, 2000
INVENTOR(S) : Hideyuki Kagawa

It is certified that error appears in the above-identified patent and that said Letters Patent is hereby corrected as shown below:

Column 22,
Line 9, change "damper" to -- clamper --;
Line 25, change "damper" to -- clamper --;
Line 44, change "damper" to -- clamper --;
Line 58, change "damper" to -- clamper --;

Column 26,
Line 34, change "damper" to -- clamper --.
Line 36, change "damper" to -- clamper --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*